US009925116B2

(12) United States Patent
Miceli et al.

(10) Patent No.: US 9,925,116 B2
(45) Date of Patent: Mar. 27, 2018

(54) CHILD PROOF CLOSURE

(71) Applicant: Tri State Distribution, Inc., Sparta, TN (US)

(72) Inventors: David A. Miceli, Reno, NV (US); Joseph A. Miceli, Spencer, TN (US)

(73) Assignee: Tri State Distribution, Inc., Sparta, TN (US)

( * ) Notice: Subject to any disclaimer, the term of this patent is extended or adjusted under 35 U.S.C. 154(b) by 239 days.

(21) Appl. No.: 14/812,501

(22) Filed: Jul. 29, 2015

(65) Prior Publication Data

US 2016/0030285 A1 Feb. 4, 2016

Related U.S. Application Data

(60) Provisional application No. 62/030,195, filed on Jul. 29, 2014.

(51) Int. Cl.

| | |
|---|---|
| ***A61J 1/00*** | (2006.01) |
| ***B65D 50/06*** | (2006.01) |
| ***A61J 1/14*** | (2006.01) |

(52) U.S. Cl.

CPC ..... *A61J 1/1437* (2013.01); *A61J 1/00* (2013.01); *A61J 1/1418* (2015.05); *B65D 50/068* (2013.01); *A61J 2205/30* (2013.01); *A61J 2205/50* (2013.01)

(58) Field of Classification Search

CPC ..... A61J 1/1437; A61J 1/1418; A61J 1/00; A61J 2205/50; A61J 2205/30; B65D 50/068

USPC ..... 215/207, 220, 302

See application file for complete search history.

(56) References Cited

U.S. PATENT DOCUMENTS

| | | | | | |
|---|---|---|---|---|---|
| 1,932,147 | A | * | 10/1933 | Sabatine | B67B 7/18 215/302 |
| 2,359,639 | A | | 10/1944 | Hanahan | |
| 2,864,519 | A | | 12/1958 | Crabbe | |
| 2,921,705 | A | * | 1/1960 | Dorsey | B65D 50/068 215/215 |
| 3,164,277 | A | | 1/1965 | Reading | |
| 3,396,864 | A | * | 8/1968 | Jones | B65D 50/068 215/215 |
| 2,485,402 | A | | 12/1969 | Tunstall | |

(Continued)

FOREIGN PATENT DOCUMENTS

| | | | |
|---|---|---|---|
| EP | 0631945 | A2 | 1/1995 |
| EP | 1522500 | A1 | 4/2005 |
| WO | 2006092699 | A1 | 9/2006 |

*Primary Examiner* — James N Smalley

(74) *Attorney, Agent, or Firm* — Luedeka Neely Group, PC

(57) ABSTRACT

A child proof closure including an outer cap having a set of spaced apart apertures extending through a top surface of the outer cap, an inner cap dimensioned and configured to be assembled within the outer cap having a set of spaced apart receivers corresponding to the at least one set of spaced apart apertures of the outer cap, and a key having a set of spaced apart projections dimensioned and configured to be inserted through the spaced apart apertures of the outer cap to engage the spaced apart receivers of the inner cap when the spaced apart apertures of the outer cap are vertically aligned with the spaced apart receivers of the inner cap for unscrewing the assembled closure from the container by turning the key.

38 Claims, 20 Drawing Sheets

(56) References Cited

U.S. PATENT DOCUMENTS

| | | | | | |
|---|---|---|---|---|---|
| 3,485,402 | A | * | 12/1969 | Tunstall | B65D 50/068 215/215 |
| 3,710,970 | A | | 1/1973 | Elfline | |
| 4,281,771 | A | * | 8/1981 | Siegel | B65D 50/068 215/215 |
| 4,496,065 | A | * | 1/1985 | Nagy | B65D 50/067 215/207 |
| 4,775,061 | A | * | 10/1988 | Coote | B65D 50/068 215/215 |
| 4,796,768 | A | | 1/1989 | Stuckey | |
| 4,854,459 | A | | 8/1989 | DeJonge | |
| 5,147,052 | A | * | 9/1992 | Minette | B65D 50/068 215/215 |
| 5,158,194 | A | * | 10/1992 | Sirgo | B65D 50/068 215/215 |
| 5,370,251 | A | | 12/1994 | Buono | |
| 5,586,670 | A | * | 12/1996 | Greenwald | B65D 55/14 215/207 |
| 6,029,834 | A | * | 2/2000 | Sanner | B65D 50/041 215/215 |
| 6,032,811 | A | | 3/2000 | Marconi | |
| 6,604,643 | B1 | | 8/2003 | Michael et al. | |
| 6,802,427 | B2 | | 10/2004 | Miceli et al. | |
| 7,000,789 | B2 | | 2/2006 | Miceli et al. | |
| 7,111,746 | B2 | | 9/2006 | Miceli et al. | |
| 7,413,095 | B2 | | 8/2008 | Bertani et al. | |
| D680,000 | S | | 4/2013 | Miceli et al. | |
| 8,919,083 | B1 | | 12/2014 | Miceli et al. | |
| 2008/0121000 | A1 | | 5/2008 | Vessa | |

* cited by examiner 20
16
14
27
24,26
25
29
12
10

18
16
14
26
12
28

12
B
28
RESISTANT
CHILD
NOT
CAUTION:
A
A
28
B 18
16
12
14

10
28
29
26

28
26
12

12
B
B
26
28
A
A
26

12
26
29

28
27
26
25
12

30

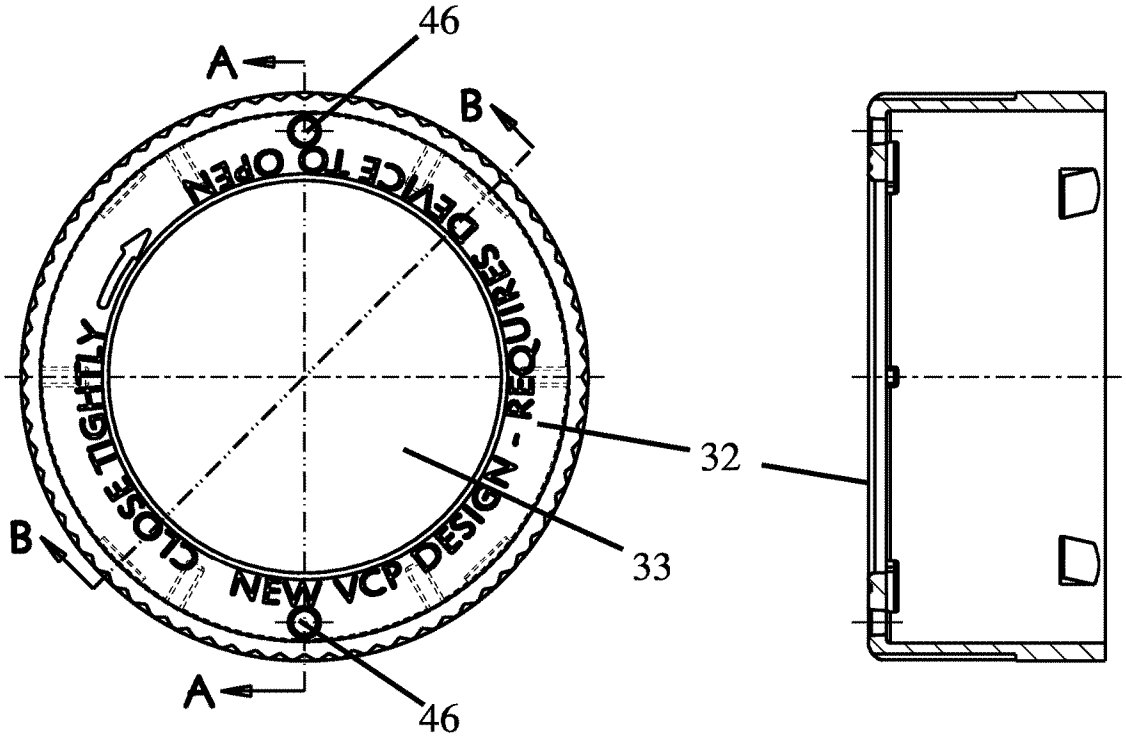
FIG. 17A
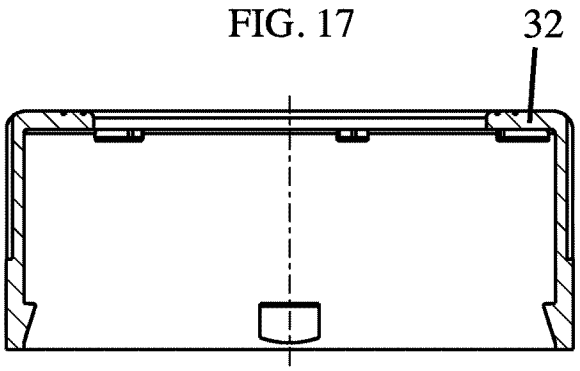
FIG. 17
FIG. 17B
30

30

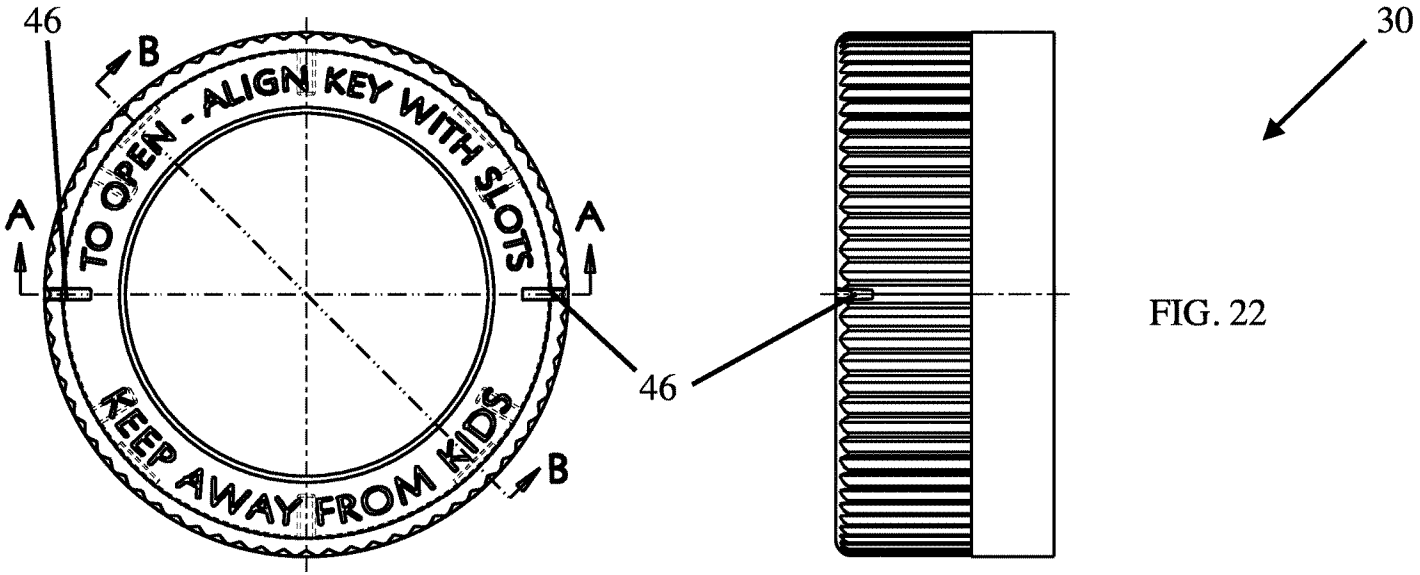
FIG. 21
FIG. 22
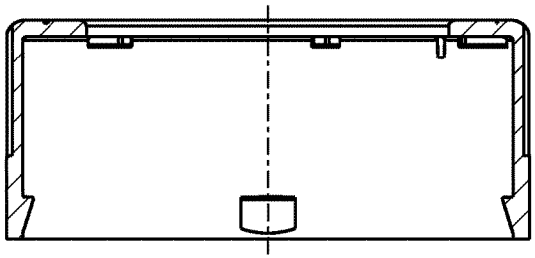
FIG. 21B
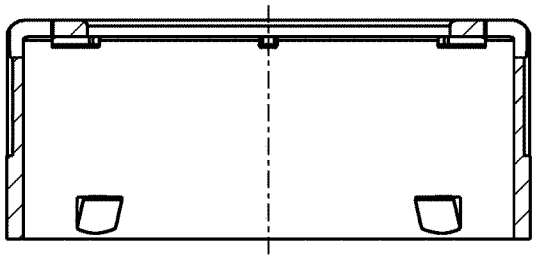
FIG. 21A

CHILD PROOF CLOSURE

CROSS-REFERENCE TO RELATED APPLICATIONS

This application claims priority to U.S. Provisional Application Ser. No. 62/030,195 filed Jul. 29, 2014, entitled "Child Proof Closure," the entire contents of which is incorporated herein in its entirety.

FIELD

This disclosure relates to two-piece closure systems utilizing a key for removing the closure system from a container.

BACKGROUND

Many pharmaceutical container closure systems, and particularly prescription container closure systems, often include a "child resistant" mode of operation, and sometimes both "non-child resistant" and "child resistant" modes. While these types of closure systems are generally very effective in preventing a child from opening the closure in the child resistant configuration, it is not impossible for children to open them (hence the name "child resistant"). In particular, a child playing with this type of closure system may sometimes be drawn to certain locking/unlocking features, such as a push-down tab, visible on the cap resulting in the child unintentionally removing the cap from its container. Also, particularly in the case of push-down-and-turn child resistant closures, the child may even figure out how to remove the closure by simply watching their parents, or even reading instructions displayed on exterior of the, and then being able to do so on their own. Accordingly, what is needed, at least as an option for consumers that have young children in their household, is a "child proof" closure system.

While many "lock-and-key" type closure systems are disclosed in the prior art in an attempt to provide an effective "child proof" closure system, no such systems have been commercialized, at least on any significant scale. This is likely due to weakness of the designs that have been introduced so far, including designs that would not be effective in actually preventing children from being able to open the containers and designs having flaws that would make the closure systems expensive to manufacture and/or impractical from a commercial standpoint.

For example, U.S. Pat. No. 6,032,811 provides a cap assembly having an outer cap member and an inner cap member each having a key slot. While the outer cap is designed to rotate independently of the inner cap, a key may be inserted into the key slots to turn the inner cap when the key slots are aligned. One of the many problems with this overly simplistic design is that the key actually comes secured to the cap, the slot on the outer surface of the outer cap is clearly visible, and the slot is configured such that ordinary household items could be inserted into the slot. Accordingly, just like children toys that teach toddlers motor skills by inserting different shapes into different slots, certain children playing with the closure could end up inserting the key or other household object into the slots. Once the key is inserted correctly, whether intentionally or not, it is very likely that the child would be able to open the container. The prior art includes many other closure systems that suffer these same deficiencies. In fact, many of the systems are actually designed such that normal household items may be used to open the closure system, such as U.S. Pat. No. 3,396,864 patent, further described below, which includes a slot designed to be used with a coin. What is needed therefore is a more discrete locking system that makes it more difficult for a child to recognize or understand how to open the closure system or otherwise prevents attracting child actions that result in the child unintentionally opening the container.

Similarly, U.S. Pat. No. 3,485,402 provides a cap assembly with two opposing key hole openings in the outer cap operable to be aligned with opposing key holes on the inner cap for engagement with a key having opposed prongs. The openings of the inner and outer cap were not designed to be discreet but to allow the key to traverse the center of the cap that includes a screw to secure the inner cap within the outer cap. This design suffers several critical flaws, most critical of which is that an additional gasket (i.e., additional expense and complexity) is needed to prevent air, moisture, leakage, etc. from coming into or escaping the container opening due to the key holes of the inner cap and the screw that is inserted through the outer and inner caps. Further, the gasket extends into the opening of the container such that, like the '864 patent described below, the '402 patent does not permit induction sealing. Also, due to the key having to traverse, the screw extending from the outer cap, pushing down on the key to insert the key prongs into the key holes with the handle would actually pivot the prongs out of the key holes.

Additionally, like the gasket and screw of the '402 patent, many of the prior art "child proof" closure systems include numerous parts, which adds thickness and cost to manufacturing the cap. For example, U.S. Pat. No. 4,796,768 describes a lockable closure cap that requires a standard type key, springs, cams, etc. to lock the closure to the container. As would be expected, this type of closure, while requiring a specialty key, would be expensive to manufacture. Further, all the various parts required to provide use of a standard key design results in a large and unattractive size for the closure and prevents the closure from being applied to a container in an automated dispensing system.

U.S. Pat. No. 3,396,864 and European Patent No. 06311945 disclose other locking caps having ratchet ramps on both the outer cap and inner cap that allow the closure assembly to be screwed onto a container when the outer cap is rotated in a clockwise direction but is designed to prevent the closure from being removed without a key when the outer cap is rotated in the counter-clockwise direction. While it is desirable in certain instances to be able to provide a closure that can be screwed onto a container but requires key to remove the closure, the '864 patent is silent as to how this would be accomplished other than including ramps on both the inner cap and outer cap. Additionally, like many of the other locking closures of the prior art, including the '811 patent described above, the key slots/indentions of the cap portions are centrally located in the '864 patent and '945 patent. This requires a pocket to be formed that extends into the interior space of the inner caps. The pocket is formed due to the needed depth of the slot of the inner cap that is configured to receive the key. This pocket prevents the opening of the closure from being lined in an induction sealing process as known in the art, and also prevents any custom branding, printing, or messaging on the cap. Further, the pocket results in additional resin being needed to form the cap, adds needless weight to the cap, and slows down the molding/cycle time required to make the closure.

In another aspect, many closure systems, particularly those designed to be child resistant, are difficult to open and close for the elderly as well as those with arthiritic hand conditions. Thus, while it would be beneficial to provide a multifunctional key that not only unlocks the closure system but also assists a user in both screwing the closure system on and off a container, the prior art has generally ignored this aspect when designing the interaction between the keys and the closure systems. For example, the '864 patent, '945 patent, and '402 patent described above provide locking closure systems in which the key engages a recess centrally located within the inner cap. Thus, the key is unable to provide much additional torque than what would already be supplied by a user that just rotates the outer cap upon engagement with the inner cap.

Further, likely because the locking closure systems of the prior art did not recognize or otherwise were unable to successfully implement a closure system in which the key provided an appreciable mechanical advantage in screwing the closure system on and off a container, none of these systems describe a closure having both a child resistant option and a key option. Such a system is advantageous in numerous situations. For example, both options may be preferred for elderly patients that have trouble opening and closing child resistant closures but also have caregivers that often dispense their medications. Thus, the elderly individual may desire a tool that assists in screwing the closure on and off a container, while the caregiver may wish to open the container using the normal child resistant function. Also, both options would be beneficial when a child resistant cap is secured to a container in automated dispensing systems. In this regard, workers required to perform spot checks of prescriptions that are dispensed in these automated systems must screw on and off countless child resistant caps, and, thus, often complain of hand pain and carpal tunnel symptoms. Providing these workers with a tool to quickly assist them in screwing on and off these child resistant caps would thus be beneficial. Also, liquid pharmaceuticals often result in the sticky pharmaceutical being spilled onto the driving structures of child resistant caps, making such structures generally ineffective. By providing a closure system in which both a child resistant and key option are available, the key can be utilized if the user has trouble opening the closure due to the driving structures having been exposed to spills of the liquid pharmaceutical.

In view of the above, what is needed therefore is a lockable closure assembly that, while providing a discrete locking system, is efficient to manufacture. Further, a system in which a user has more options of varying degrees of difficulty to open the closure system based on the consumer's particular circumstances, including a key that serves as an effective tool to make the closure system easy to open and close when used, is desired.

SUMMARY

A closure is disclosed including an outer cap having at least one drive element disposed proximate a top interior surface of the outer cap and at least one aperture extending through an exterior surface of the outer cap proximate the top surface. An inner cap dimensioned and configured to be assembled within the outer cap includes a closure engaging mechanism disposed on an interior surface of the inner cap dimensioned and configured to engage a corresponding container engaging mechanism for securing the inner cap to a container, at least one drive element including a key receiver disposed proximate a top exterior surface of the inner cap operable to engage the at least one drive element of the outer cap when the outer cap is turned in a first direction to screw the assembled closure onto a container. The system further includes a key having at least one projection extending from a handle portion, the at least one projection dimensioned and configured to be inserted through the at least one aperture of the outer cap to engage the key receiver of the at least one drive element of the inner cap when the at least one aperture of the outer cap is vertically aligned with the key receiver of the inner cap and the key is rotated in at least the second direction for removing the assembled closure from the container.

According to certain embodiments, the outer cap includes a plurality of drive elements disposed proximate a periphery of the top interior surface and at least one set of spaced apart apertures disposed proximate a periphery of the exterior surface, the inner cap includes a plurality of drive elements disposed proximate a periphery of the top exterior surface with at least a portion of the plurality of drive elements including key receivers for forming a set of key receivers, and the key includes a set of spaced apart projections, the assembled closure dimensioned and configured such that the set of spaced apart projections are operable to be inserted through the at least one set of apertures of the outer cap to engage the set of key receivers of the inner cap. In certain embodiments, the plurality of drive elements of the outer cap and the plurality of drive elements of the inner cap are dimensioned and configured to permit removal of the assembled closure upon a push-down-and-turn action being applied to the outer cap in the second direction. According to this embodiment, the plurality of drive elements of the inner cap preferably include pockets as the set of key receivers disposed in the top surface of the inner cap having opposing side walls extending substantially perpendicular from the top surface.

According to other embodiments, the at least one drive element of the outer cap and the at least one drive element of the inner cap are dimensioned and configured to prevent removal of the assembled closure upon a push-down-and-turn action being applied to the outer cap in the second direction. According to this embodiment, the at least one drive element of the outer cap and the at least one drive element of the inner cap includes an elongated ramp surface rising from a proximal end to a distal end at an angle of 20 degrees or less; at least one of the inner cap and outer cap may be molded with a lubricating agent; and/or the closure further includes a second inner cap operable to be assembled with the outer cap dimensioned and configured so that the at least one drive element of the outer cap is operable to engage the at least one drive element of the inner cap when the second inner cap is assembled within the outer cap and the outer cap is turned in the second direction.

In certain embodiments, the at least one projection of the key is configured to be removeably attached to the at least one drive element of the inner cap; at least one aperture of the outer cap is vertically aligned with the key receiver of at least one drive element of the inner cap when a user turns the outer cap in the first direction such that the at least one drive element of the outer cap is in engagement with the at least one drive element of the inner cap; the outer cap includes one or more grooves disposed in the top surface leading to the at least one aperture for assisting a user in locating the at least one aperture with the at least one projection of the key; the handle portion of the key includes a width that is greater than the diameter of the outer cap; and/or the inner cap is operable to be secured to the container unassembled from the outer cap in a non-child resistant configuration.

According to another embodiment of the disclosure, a closure includes an outer cap including at least one drive element disposed proximate a top interior surface of the outer cap and at least aperture extending through an exterior surface of the outer cap and an inner cap dimensioned and configured to be assembled within the outer cap. The inner cap includes a closure engaging mechanism disposed on an interior surface of the inner cap dimensioned and configured to engage a corresponding container engaging mechanism for securing the inner cap to a container; at least one drive element disposed proximate a top exterior surface of the inner cap operable to engage the at least one drive lement of the outer cap when the outer cap is turned in a first direction to screw the assembled closure onto a container and permit removal of the assembled closure upon a push-down-and-turn action being applied to the outer cap in a second direction; and a key receiver disposed proximate an exterior surface of the inner cap. The closure further includes a key having at least one projection extending from a handle portion, the at least one projection dimensioned and configured to be inserted through the at least one aperture of the outer cap to engage key receiver of the inner cap when the at least one aperture of the outer cap is vertically aligned with the key receiver of the inner cap and the key is rotated in at least the second direction for removing the assembled closure from the container.

According to certain embodiments, the outer cap includes a plurality of drive elements disposed proximate a periphery of the top interior surface and at least one set of spaced apart apertures disposed proximate a periphery of the exterior surface, the inner cap includes a plurality of drive elements disposed proximate a periphery of the top exterior surface with at least a portion of the plurality of drive elements including key receivers for forming a set of key receivers, and the key includes a set of spaced apart projections operable to be inserted through the at least one set of apertures of the outer cap to engage the set of key receivers of the inner cap.

According to certain embodiments, the plurality of drive elements of the inner cap include pockets disposed in the top surface of the inner cap having opposing side walls extending substantially perpendicular from the top surface, the pockets forming the set of key receivers of the inner cap. According to this embodiment, the plurality of drive elements of the outer cap include ratchet ramps.

According to another embodiment of the disclosure, a closure includes an outer cap including at least one drive element disposed on an interior surface of the outer cap and at least one aperture extending through an exterior surface of the outer cap and an inner cap dimensioned and configured to be assembled within the outer cap. The inner cap includes a closure engaging mechanism disposed on an interior surface of the inner cap dimensioned and configured to engage a corresponding container engaging mechanism for securing the inner cap to a container, at least one ratchet ramp disposed proximate a periphery of a top exterior surface of the inner cap including an elongated ramp surface dimensioned and configured so that the at least one drive element of the outer cap is operable to engage the at least one ratchet ramp when the outer cap is turned in a first direction to screw the assembled closure onto a container while preventing a user to apply a depressive axial force and simultaneous turning of the outer cap in a second direction opposite the first direction to unscrew the assembled closure from the container, and at least one receiver corresponding to the at least one aperture of the outer cap. The closure further includes a key having at least one projection extending from a handle portion dimensioned and configured to be inserted through the at least one aperture of the outer cap to engage the at least one receiver of the inner cap when the at least one aperture of the outer cap is vertically aligned with the at least one receiver of the inner cap for unscrewing the assembled closure from the container by rotating the key in the second direction.

According to certain embodiments, the at least one receiver is integrated with the at least one ratchet ramp; the at least one ratchet ramp includes a top ramp surface and the at least one receiver includes a first receiver includes an indention disposed in the top ramp surface; the indention includes an elongated slot formed into the top ramp surface; the inner cap further includes a circumferential sidewall and a portion of the at least one ratchet ramp includes a reduced width that provides space between the ratchet ramp and the periphery of the inner cap forming the at least one set of spaced apart receivers in the space; the inner cap further comprises a circumferential sidewall and a top exterior surface, the top exterior surface being recessed within the circumferential side wall to provide depth to the at least one ratchet ramp disposed between the top exterior surface and the circumferential side wall of the inner cap.

According to yet another embodiment of the disclosure, a closure includes an outer cap having at least one set of spaced apart apertures disposed proximate a periphery of a top surface of the outer cap and an inner cap dimensioned and configured to be assembled within the outer cap. The inner cap includes a closure engaging mechanism disposed on an interior surface of the inner cap dimensioned and configured to engage a corresponding container engaging mechanism for securing the inner cap to a container and at least one set of spaced apart receivers corresponding to the at least one set of spaced apart apertures of the outer cap such that the spaced apart apertures of the outer cap are operable to be vertically aligned with the spaced apart receivers of the inner cap. The closure further includes a key having at least one set of spaced apart projections extending from a handle portion, the spaced apart projections dimensioned and configured to be inserted through the at least one set of spaced apart apertures of the outer cap to engage the at least one set of spaced apart receivers of the inner cap when the spaced apart apertures of the outer cap are vertically aligned with the spaced apart receivers of the inner cap for screwing and unscrewing the assembled closure from the container by turning the key.

According to certain embodiments, the at least one set of spaced apart projections of the key are configured to be removeably attached to the at least one set of spaced apart receivers of the inner cap; the outer cap includes one or more grooves leading to each of the apertures of the at least one set of apertures for assisting a user in locating the apertures with the set of spaced apart projections of the key; the handle portion of the key includes a width that is at least substantially equal to a diameter of the outer cap; the handle portion of the key includes a width that is greater than the diameter of the outer cap; the inner cap is operable to be secured to the container unassembled from the outer cap in a non-child resistant configuration; the inner cap and outer cap are operable to permit removal of the assembled closure upon a push-down-and-turn action being applied to the outer cap; and/or the inner cap and outer cap are operable to prevent removal of the assembled closure without the key.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein:

FIG. 17 is a top view of an outer cap according to another embodiment of the disclosure;

FIGS. 17A-17B are cross sectional views of the outer cap of FIG. 17;

FIG. 21 is a top view of an outer cap according to another embodiment of the invention;

FIGS. 21A-21B are cross sectional views of the outer cap of FIG. 21;

FIG. 22 is a side view of the outer cap of FIG. 21;

DETAILED DESCRIPTION

The disclosure relates to two piece closure systems utilizing a key to assist in rotating the closure system with respect to a container. In certain embodiments, the closure system is a child "proof" (as opposed to child resistant) closure system requiring a special key in order to remove the closure from a container. In other embodiments, the closure system is an "enhanced" child resistant closure system that permits removal of the assembled closure upon a push-down-and-turn action being applied by the user or, to take advantage of a mechanical advantage supplied by a key as explained below, by using the key to screw on and off the closure system. Finally, in certain embodiments, the closure system is a modified child proof closure system designed to make it more difficult for a user to remove the assembled closure by applying a push-down-and turn action (e.g., prevent children from being able to remove the closure but allow stronger individuals such as caregivers to be able to remove the closure if enough force is applied) that also permits use of a key to easily screw on and off the modified child proof closure system. The closure systems of the present disclosure are primarily directed for use with containers intended to store and dispense pharmaceutical products, and particularly prescription pharmaceuticals. However, the systems may also be used with other types of containers in which closure systems as described above are desired.

Figures 1, 1A, 1B, 2:
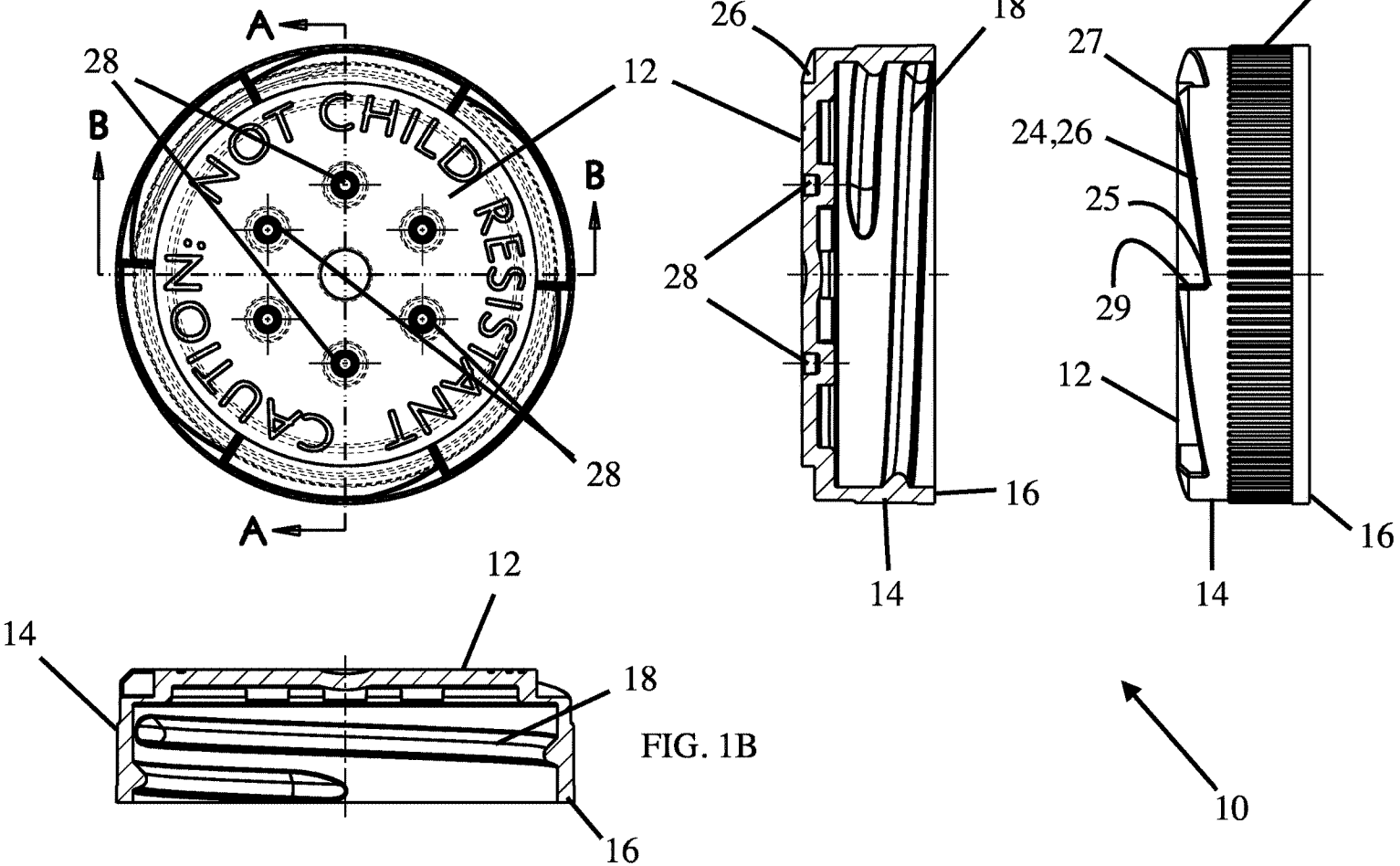
FIG. 1 is a top view of an inner cap according to one embodiment of the disclosure.
FIG. 1A-1B are cross sectional views of the inner cap of FIG. 1.
FIG. 2 is a side view of the inner cap of FIG. 1.
Figure 3A:
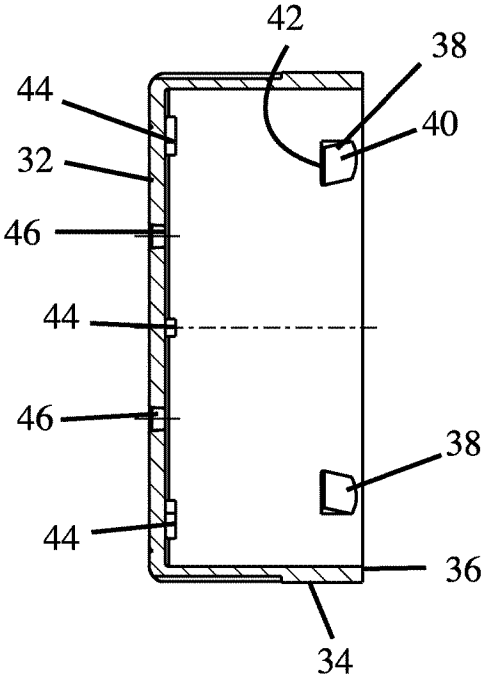
FIGS. 3A-3B are cross sectional views of the outer cap of FIG. 3.
Figure 3:
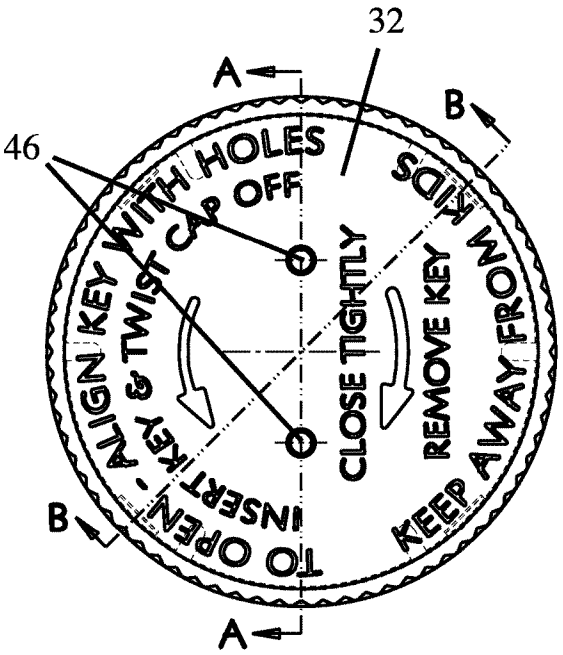
FIG. 3 is a top view of an outer cap according to one embodiment of the disclosure.

One embodiment of the closure system is exemplified in FIGS. 1-6. Referring first to FIGS. 1-3, the closure system includes an inner cap 10 dimensioned and configured to removeably engage a container and an outer cap 30 for receiving the inner cap 10. As described more fully in U.S. Pat. No. 8,209,944, the contents of which are hereby incorporated herein by reference, the inner cap 10 may be used alone as a non-child resistant cap. However, when the inner cap 10 is assembled within the outer cap 30, a child proof closure system is created as explained below. Accordingly, the pharmacist and/or user of the closure system can determine whether to attach the inner cap 10 to the outer cap 30 based on whether a non-child resistant or child proof cap is desired.

Referring to FIGS. 1A-1B, the inner cap 10 includes a closed top surface 12, a circumferential side wall 14, an open bottom surface 16, and a closure engaging mechanism 18. The closure engaging mechanism 18 is dimensioned and configured to engage a corresponding engaging mechanism of a container such that the top surface 12 covers the opening of the container. In preferred embodiments, the engaging mechanism 18 is a single thread disposed on the interior surface of the circumferential side wall 14 as shown. However, the engaging mechanism 18 could also be a double thread, one or more beads, or other similar engaging mechanisms known in the art. Referring to FIG. 2, the inner cap 10 may also include a gripping element 20, such as knurlments, to provide a gripping surface for opening the inner cap 10 in the non-child resistant configuration (i.e., when the inner cap 10 is free from the outer cap 30).

Figure 3B:
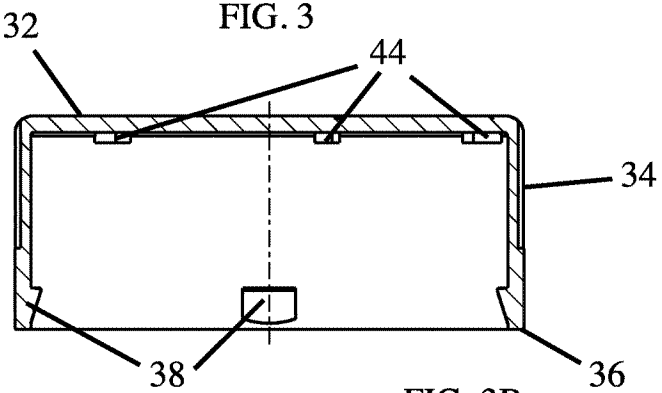

Referring to FIGS. 3A-3B, the outer cap 30 also includes a top surface 32, which may be closed as shown or open as provided below, a circumferential side wall 34, and an open bottom surface 36. The interior surface of the side wall 34 includes one or more tab elements 38 for engaging the bottom surface 16 of the inner cap 10 and securing the inner cap 10 within the outer cap 30. In preferred embodiments, and as shown in the tab element 38 of FIG. 3A, each tab element 38 includes an angled ramp 40 leading to a substantially flat surface 42. The angled ramp 40 facilitates the side wall 14 of the inner cap 10 in traversing the side wall 34 of the outer cap 30 until the flat surface 42 engages the bottom surface 16 of the inner cap. Once the flat surface 42 of the outer cap engages the bottom surface 16 of the inner cap 10, the inner cap 10 is generally considered permanently fixed to the outer cap 30 to prevent any unwanted shelling or removal of the outer cap 30 from the inner cap 10.

The assembled inner cap 10 and outer cap 30 are further provided with corresponding drive elements such that the outer cap 30 engages and turns the inner cap 10 in a first direction, preferably in a clockwise direction, thereby permitting the closure engaging mechanism 18 of the inner cap 10 to engage the container engaging mechanism for securing the assembled closure to a container. Referring particularly to FIG. 2, the inner cap drive element of this embodiment includes one or more ratchet ramps 24 disposed proximate the periphery of the top surface 12 of the inner cap 10. The ratchet ramps 24 are operable to receive one or more drive teeth 44 disposed along the interior of the top surface 32 of the outer cap 30. In order to allow the outer cap 30 to engage the inner cap 10 in only one direction (i.e., to close the container while preventing the ability to "push-down-and-turn" to remove the closure), each ratchet ramp 24 is preferably configured to prevent a user from unscrewing the assembled closure from the container by applying a depressive axial force and simultaneous turning action ("push-down-and-turn") of the outer cap in a second direction opposite the first direction. In other words, while the drive teeth 44 are able to engage the ratchet ramps 24 to turn the inner cap 10 in the first direction for installing the assembled closure onto a container, the drive elements are configured so that, the drive teeth 44 are unable to engage the ratchet ramps 24 in the second direction even if the user applies a "push-down-and-turn" action on the assembled closure. According to this embodiment, it should be understood that if enough force is applied, an exceptionally strong user might be able to get the drive teeth 44 to engage the ratchet ramps 24 in the second direction, but the preventing means are configured to prevent typical users, and children at a minimum, from being able to remove the assembled closure from the container without a key as described below.

In preferred embodiments, the "push-down-and turn" preventing means is accomplished by providing the ratchet ramps 24 with an elongated ramp surface 26 gradually rising from a proximal end 25 towards a distal end 27. In preferred embodiments, the elongated ramp surface 26 rises at an angle of about 20 degrees or less. In most preferred embodiments, the angle is about 15 degrees or less. At the distal end 27, the ramp surface 26 ends at a steep slope 29 and the next successive ratchet ramp 24 begins at the bottom of the steep slope. Accordingly, the drive teeth 44 of outer cap 30 will engage the steep slopes 29 of the ratchet ramps 24 when the drive teeth 44 move along the ramp surface from the distal end 27 to the proximal end 25 to screw the assembled cap onto a container. However, when the drive teeth 44 move from the proximal end 25 towards the distal end 27, the drive teeth 44 fail to engage the ratchet ramps 24 when attempting to unscrew the assembled cap from the container even when a depressive force is also applied.

In addition to or in replace of the elongated ramp surfaces, one or both of the inner cap 10 and outer cap 30 may be provided with a slip agent or additive that further assists in preventing the drive teeth 44 from engaging the second end 27 of the ratchet ramp 24 or any other portion of the inner cap 10. Thus, in preferred embodiments including the slip agent in addition to the gradual slope of the ratcht ramp 24 makes it essentially impossible for a user to remove the closure from the container by pushing down and turning. In preferred embodiments, the slip agent includes an ultra high molecular weight ("UHMW") polymer molded into the inner cap 10 and/or outer cap 30 to serve as a lubricating agent and provide enhanced lubricity between contacting surfaces of the inner cap 10 and outer cap 30. In preferred embodiments, the UHMW polymer, a term used to refer to macromolecules with molecular weights that exceed $10^6$ g/mol, is selected from a polymer such as polyethylene, polypropylene, polystyrene, polyisobutylene, polyacrylamide, polyisoprene, polyethyleneoxide, polytetrafluoroethylene, polymethylmethacrylate, polyvinylalcohol, polyacrylicacid, polyvinylacetate, nylon-6, nylon-4, and siloxane. In most preferred embodiments, the UHMW polymer is UHMW siloxane.

In typical embodiments, the UHMW polymer is provided as an UHMW lubricating additive that includes approximately 25-70%, and most preferably about 50%, of the UHMW polymer dispersed in a thermoplastic carrier resin such as high-density polyethylene (HDPE), polypropylene (PP), acetal, high impact polystyrene (HIPS), or styrene-acrylonitrile (SAN). In preferred embodiments, the carrier resin is a HDPE polymer. A compatible UHMW lubricating additive having siloxane as the UHMW polymer and a HDPE polymer as its carrier resin is available commercially as DOW CORNING® MB50-314 Masterbatch.

The amount and type of the slipping additive, as well as the slope of the ramp surfaces 26, can be varied as desired to vary the ability to open the container without the use of the key as described below. In preferred embodiments, and as described above, the slope and slipping additive are used to make it essentially impossible to remove the closure assembly from a container using ratchet ramps 24 and drive teeth 44. However, in certain embodiments, it may be desired to allow for both a highly forceful push-down-and-turn functionality in addition to the key opening. For example, the slope and slipping additive may be designed so that young children are not strong enough to remove the closure assembly, which results in an elderly person also not being able to use the push-down-and-turn functionality of the closure assembly. Thus, the elderly patient is given a key to remove the closure assembly. However, if the elderly person loses or misplaces the key, a caregiver will be able to open the container without the key. Additionally, different outer caps 30 could be provided to be used with the same inner cap 10 depending on whether the user or patient wants push-down-and-turn functionality. For example, a first set of outer caps 30 could be molded with the slip additive while a second set of outer caps 30 are molded without the slip additive. The ratchet ramps 24 are then configured such that the push-down-and-turn functionaility is enabled when the inner cap 10 is combined with an outer cap 30 from the second set but is not permitted when combined with an outer cap 30 from the first set.

Figures 4, 5:
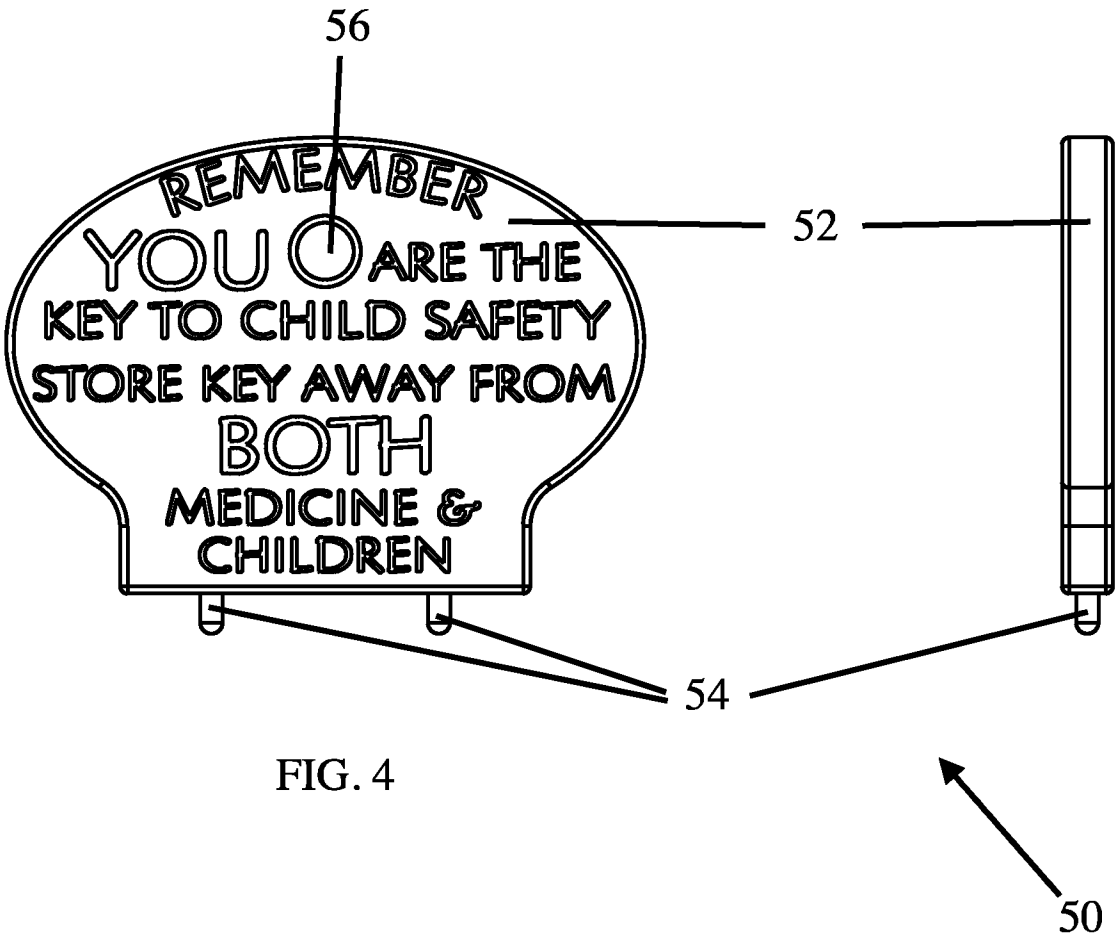
FIG. 4 is a front view of a key according to one embodiment of the disclosure.
FIG. 5 is a side view of the key of FIG. 4 according to one embodiment of the disclosure.
Figure 6A:
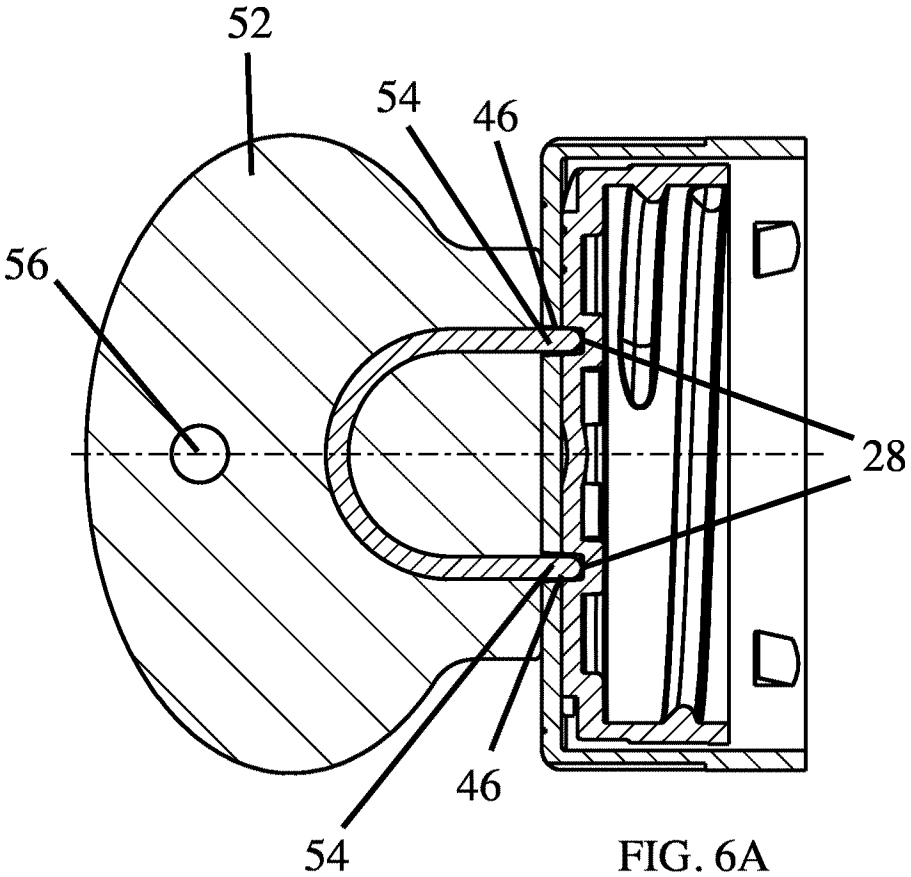
FIG. 6A is a cross sectional view of the closure assembly of FIG. 6.
Figure 6:
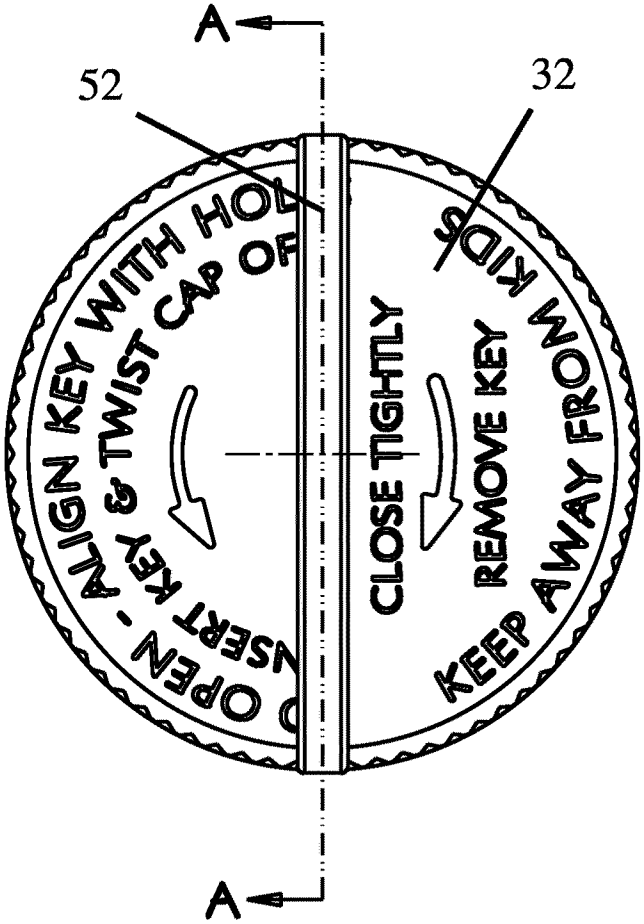
FIG. 6 is a top view of a closure assembly including the inner cap of FIG. 1, the outer cap of FIG. 3, and associated key of FIG. 4.

Due to the arrangement where the drive teeth 44 will not engage the ratchet ramps 24 for removing the cap assembly from the container, a key 50 is required to remove the cap assembly. While the key 50 may take many forms so long as it includes a portion configured to be inserted through the outer cap 30 to engage inner cap 10, in preferred embodiments, as shown in FIGS. 4-5, the key 50 includes a handle portion 52, two spaced apart unlocking pins or projections 54 extending from the handle portion 52, and a key ring aperture 56 for securing the key to a user's key ring to prevent loss of the key 50. Referring to FIG. 3, the top surface 32 of outer cap 30 includes two appropriately spaced and configured pin apertures 46 for inserting the unlocking pins 54 of key 50. Further, top surface 12 of inner cap 10 includes at least one set of appropriately spaced and configured key receivers 28 for receiving the unlocking pins 54 inserted through the pin apertures 46 of the outer cap 30 when one set of receivers 28 is aligned with the pin apertures 46. Thus, referring to FIGS. 6 and 6A, when one set of receivers 28 are vertically aligned with the pin apertures 46, the key 50 is operable to engage the cap assembly by passing the unlocking pins 54 through the pin apertures 46 of outer cap 30 and into the receivers 28 of the inner cap 10. As a result, the outer cap 30 is in mating engagement with the inner cap 10 such that the cap assembly may be screwed off the container by turning the key 50 or the outer cap 30 in the second direction (i.e., counter-clockwise).

In preferred embodiments, the unlocking pins 54 of key 50, pin apertures 46 of outer cap 30, and receivers 28 of inner cap 10 are sufficiently small such that the potential for alignment of the apertures 46 and receivers 28 is not discernible when viewing the closure assembly, at least to a child. In particular, receivers 28 of inner cap 10 are not visible through the outer cap 30 unless the receivers 28 are in precise alignment with apertures 46. Further, due to the small size of apertures 46 and receivers 28, it is not immediately recognizable that the inner cap 10 even has receivers 28 when rotating the outer cap 30 with respect to the inner cap 10. In preferred embodiments, circular apertures 46 and receivers 28 are less than about 3 mm in diameter. However, it is noted that, the size can vary depending on the stiffness and strength of the material used for forming the pins 54. Stronger materials for the pins 54 (e.g., steel) allows for the pins 54 to be smaller, which consequently allows for smaller engagement structures, which is one of the primary objectives of the present disclosure because the size and spacing of the pins 54, apertures 46, and receivers 28 preferably prevent typical household items such as coins, screwdrivers, etc. from being used as keys. In other words, in preferred embodiments, small pins 54 are provided so that the small size of the apertures 46 and receivers 28 prevent people from opening the container unless they have the specially designed key 50, and, even if they have the key 50, know exactly how the key 50 should be used to remove the closure assembly.

In order to assist in alignment of the receivers 28 with the apertures 46, the closure assembly is preferably provided with a self-aligning feature. In preferred embodiments, the self-aligning feature is provided by positioning the receivers 28 on the top surface 12 of the inner cap 10 such that the receivers 28 are aligned with the apertures 46 when the outer cap 30 is positioned with respect to the inner cap 10 such that the driving teeth 44 abut the steep slope of the first end 25 of ratchet ramp 24 (i.e., the driving teeth 44 engage the ratchet ramp by rotating the outer cap in the first direction). Thus, in order to align the receivers 28 and apertures 46, a user rotates the outer cap 30 in the first direction until it feels resistance from the driving teeth 44 abutting the first end 25 of the ratchet ramp 24. Once the user feels resistance, the user will know that the apertures 46 of the outer cap 30 should be aligned with the receivers 28 of the inner cap 10.

As shown, the handle portion 52 of key 50 preferably includes a width that is substantially equal to the diameter of the outer cap 30. This width not only allows for the spaced apart pin 54 configuration, but it converts the closure and container assembly into an easy open container. In this regard, both the spaced-apart pins 54 engaging spaced apart receivers 28 of the inner cap and the width of the handle portion provides a fulcrum effect/mechanical advantage to the user and enables the closure assembly to be more easily tightened and removed by rotating the key 50 as opposed to the outer cap 30. Thus, the key 50 is multifunctional. It unlocks the closure assembly and also converts the child proof cap into an easy open container upon proper use of the key 50.

Figure 25A:
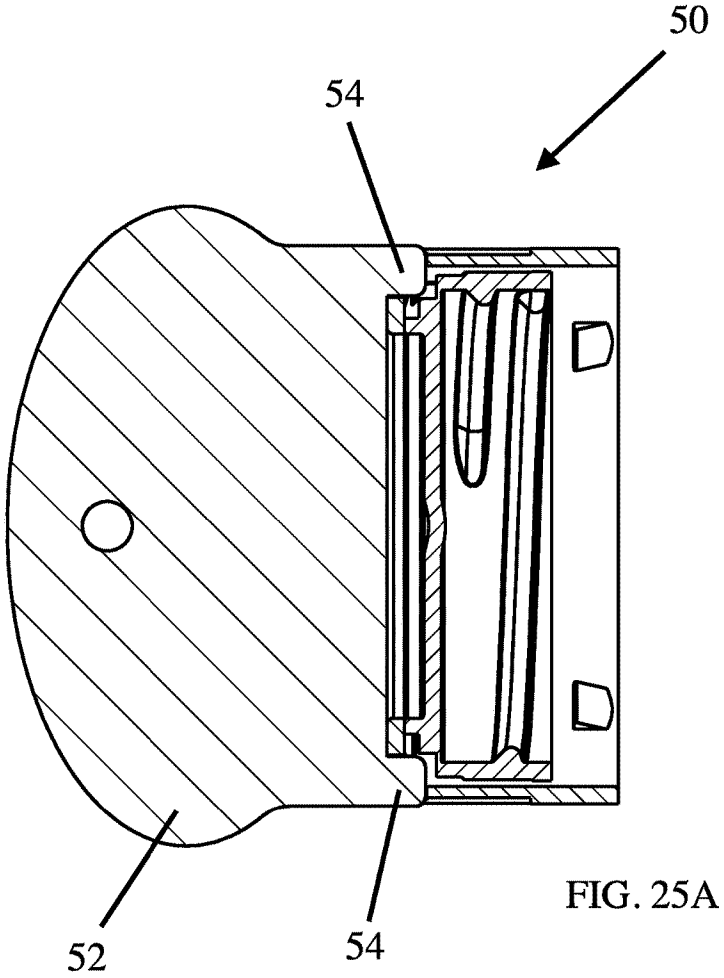
FIG. 25A is a cross sectional view of the closure assembly and associated key of FIG. 25.
Figure 25:
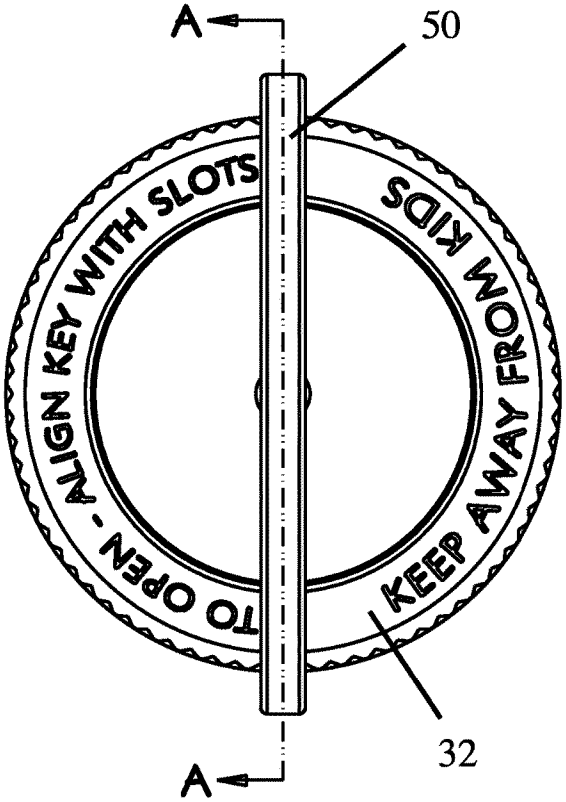
FIG. 25 is a top view of a closure assembly receiving a key according to one embodiment of the disclosure.
Figure 26:
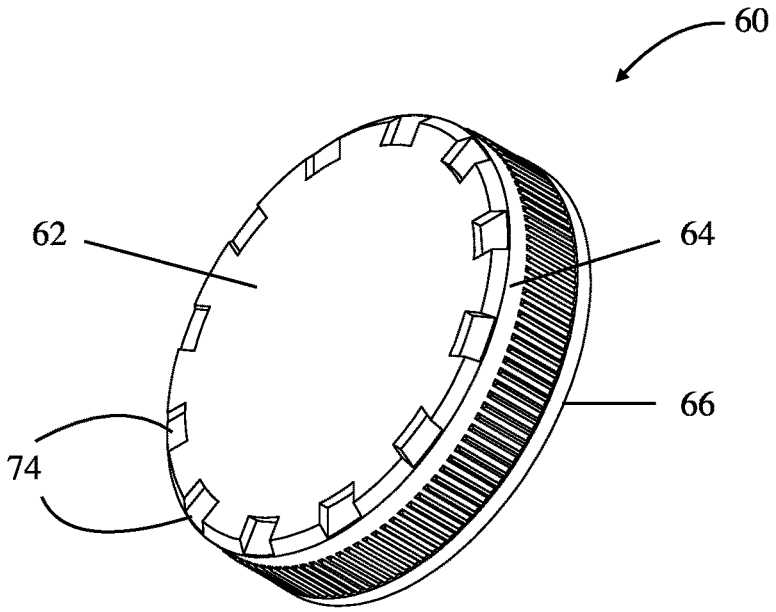
FIG. 26 is a top perspective view of an inner cap according to another embodiment of the disclosure.
Figure 27:
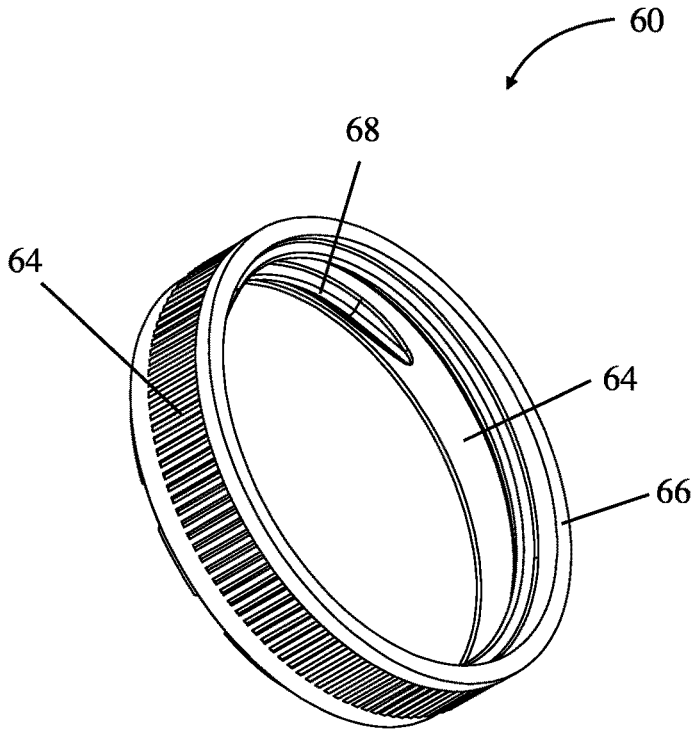
FIG. 27 is a bottom perspective view of the inner cap of FIG. 26.
Figure 28:
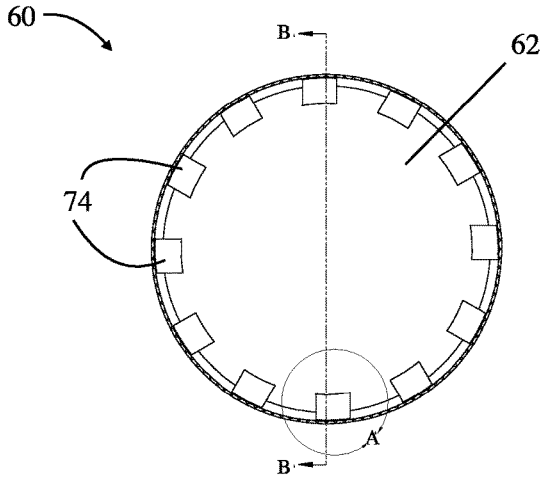
FIG. 28 is a top view of the inner cap of FIGS. 26-27.
Figure 28A:
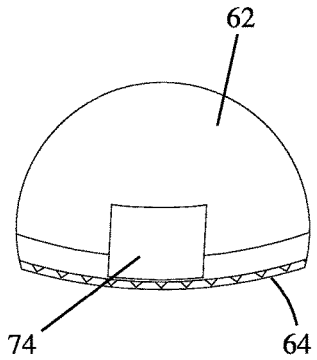
FIG. 28A is an exploded view of the "A" region of FIG. 28.
Figure 28C:
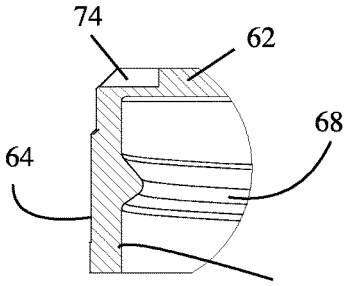
FIG. 28C is an exploded view of the "C" region of FIG. 28B.
Figure 28B:
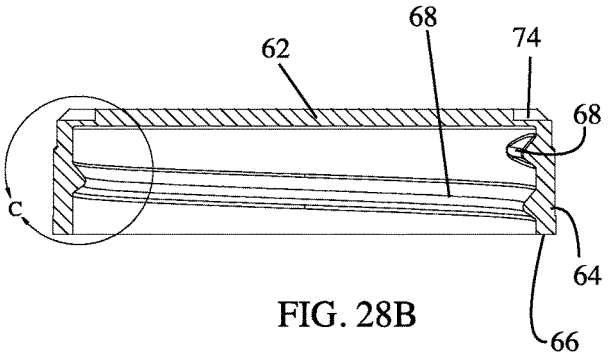
FIG. 28B is a cross sectional view taken from plane "B" of FIG. 28.

In certain embodiments such as the key shown in FIG. 25, the width of the key 50 is greater than diameter of the outer cap. It is noted that the prior art includes closures having a handle portion extending from the top of closure. However, these handle portions are part of the closure mold and, thus, permanently attached to the closure. Further, due to the permanent attachment in view of manufacturing, shipping, and packaging considerations, the width of the handle portion of prior art closures do not extend further than the diameter of the closure. As a result, the smaller handle portions of the prior art do not provide much of a mechanical advantage to the user, particularly when included on smaller closures.

In certain embodiments, the unlocking pins 54 of key 50 are configured to be removeably attached (i.e., detachable) to the receivers 28 of inner cap 10. According to this embodiment, the user can choose to leave the key 50 in the closure assembly to provide an easy open closure and container assembly. However, when the user would like to child proof the closure, the user simply removes the key. The detachable key 50 is preferably removeably secured to the receivers 28 of the inner cap by pushing down on the key 50 such that the unlocking pins 54 "snap" into receivers 28. Tapering the indentions of the receivers 28 or having receivers 28 with tight tolerances as compared to the unlocking pins 54 preferably accomplishes the "snap" attachment. Alternately, the pins 54 may be configured to be permanently removable. For example, the closure system may be initially molded with an easy open handle configured to be permanently detached from the inner cap 10 to be used as a key. Other known removeably attaching and permanently detaching mechanisms as known in the art such as magnets, adhesives, etc. may be used.

According to certain embodiments, the user may be given two keys 50 for use with the same child proof closure assembly. One is a detachable key such that the user may removeably secure the key to the closure if desired. The second is a key 50 where the pins 54 fit loosely into the receivers 28 such that the key 50 must separately engage the closure assembly each time the user wants to remove the closure assembly from the container. According to another embodiment, the same key 50 includes two sets of pins 54 having different sizes. One set of pins 54 will fit loosely into the apertures 46 and receivers 28 such that the key 50 has to be inserted each time the user wishes to remove the closure assembly from the container. The second set of pins 54 may then be configured to fit tightly to at least one of the receivers 28 or apertures 46 for those users that want to leave the key 50 attached to the closure assembly. Alternatively, the key 50 includes one set of pins 54 and the inner cap includes different sized or configured receivers 28. One set of receivers will be larger to receive the pins 54 loosely, while the other set of receivers are smaller such that the pins 54 will snap into the receivers to removeably secure the key 50 to the closure assembly. A window may also be provided in the outer cap 30 such that indicia on the inner cap 10 indicating alignment of "loose" or "tight" receivers 28 with apertures 46.

In certain embodiments, preferably where the detachable key 50 is used that can remain with the closure assembly when desired, the ratchet mechanism of the inner 10 and outer caps 30 may be removed. Thus, the key 50 is used to both open and close the closure and container assembly.

In another aspect of the disclosure, different inner caps could be provided such that a user could decide wither they want to assemble outer cap 30 with an inner cap 10 as described herein or assemble outer cap 30 with a different inner cap that allows the drive elements 44 to engage the inner cap to open the container in a child-resistant mode. In other words, according to this embodiment, the user has three options: 1) use just an inner cap for a non-child resistant mode; 2) assemble inner cap 10 with outer cap 30 to provide a "child proof" closure assembly; or 3) assemble the alternate inner cap 10 with outer cap 30 to provide a "child resistant" system. Yet a fourth option may also be provided as described above where the slope of the ratchet ramps on the inner cap 10 and amount of slip additive are varied to provide a modified child proof closure system designed to make it more difficult for a user to remove the assembled closure by applying a push-down-and turn action while also permitting use of a key to easily screw on and off the modified child proof closure system.

Referring to FIGS. 7-20, alternate embodiments of the closure assembly are provided where the apertures 46 of the outer cap 30 and receivers 28 of the inner cap 10 have been moved to the periphery of the top surfaces of the respective caps. Moving the apertures 46 and receivers 28 to the periphery has several advantages. First, increased spacing between the pins 54 of key 50 increases the fulcrum effect described above, making it easier for the user to apply torque to the closure assembly. Further, when the receivers 28 are positioned closer to the center of the top surface 12 of the inner cap 10, the receivers 28 will typically form pockets extending into the interior space of the inner cap 10. The pockets are formed due to the needed depth of the receivers 28 to receive the drive pins 54 of key 50 as compared to the typical thickness of the top surface 12 of the cap. Such pockets make it more difficult to line the opening of the container in an induction sealing process as known in the art. To prevent the pockets from extending into the interior space of the inner cap 10, the entire top surface 12 could be made thicker or a lip could be added underneath the top surface 12 to match the depth of the pockets such that the lip of the container will contact the interior lip of the inner cap 10 when the inner cap 10 is applied to the container. However, both of these solutions require additional material to form the inner cap resulting in increased expenses. Further, when the inner cap 10 is clear or otherwise see-through so that indicium on a liner disposed in the inner cap is visible, the additional lip would interfere with the indicium. Finally, any apertures situated towards the center of the outer shell of the cap, and thus requiring pockets molded into the center of the inner cap into which the pins of the key fit, will prevent the common and much desired practice of decoration via imprinting or embossing (molding) of logos and brand names on the inner and outer caps.

As a result, it is desirable to prevent the pockets altogether, particularly in embodiments where the containers will be induction sealed using the inner caps 10. To prevent the pockets, the apertures 46 and receivers 28 are moved to the periphery of their respective caps as noted above. To provide receivers 28 proximate the periphery of the inner cap, the receivers 28 are preferably integrated within the structure of the ratchet ramps 24. In other words, the same drive elements of the inner cap that are engaged by the drive teeth 44 of the outer cap 30 are engaged by the pin 54 of key 50.

Figures 7, 7A, 7B, 8, 9:
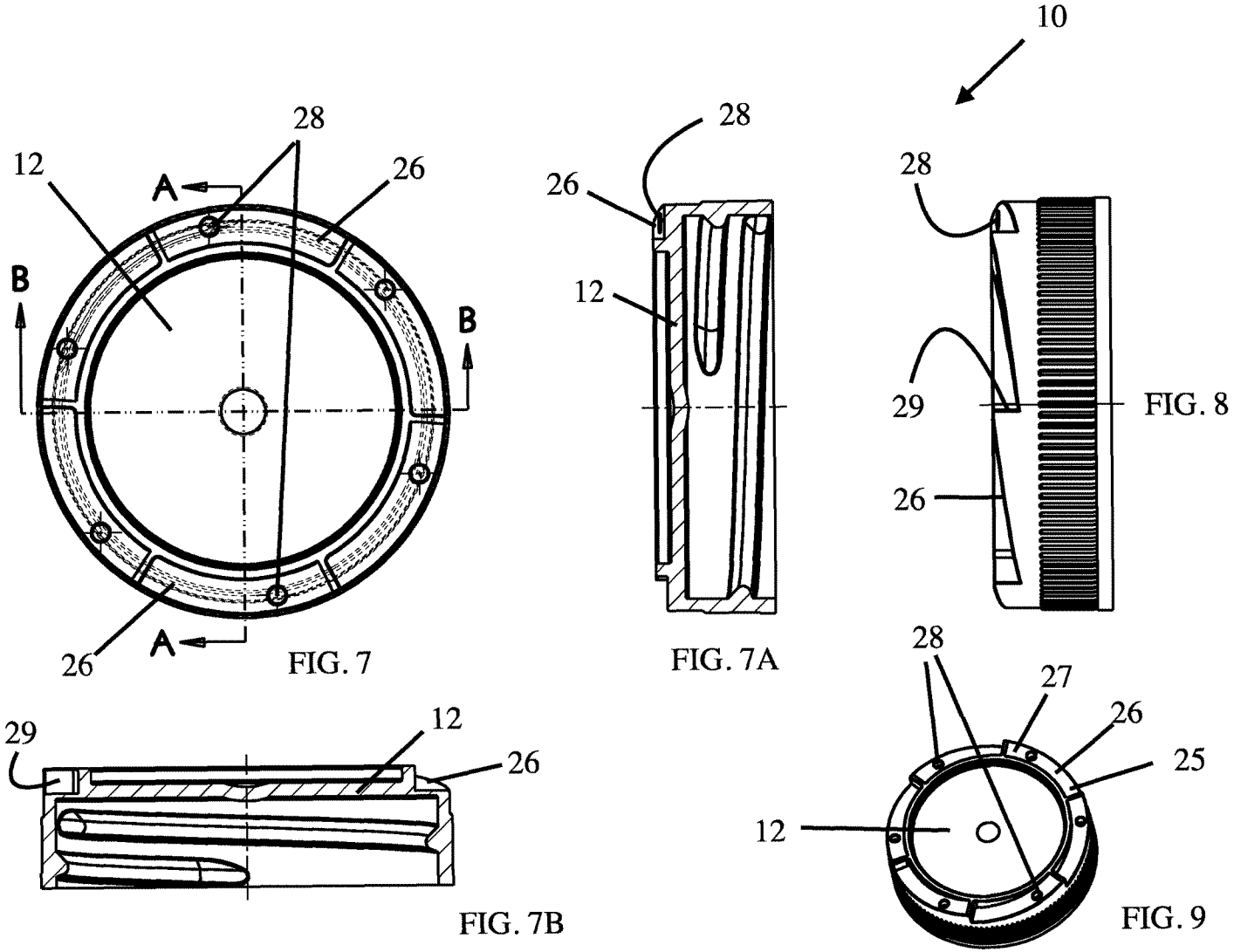
FIG. 7 is a top view of an inner cap according to another embodiment of the disclosure.
FIGS. 7A-7B are cross sectional views of the inner cap of FIG. 7.
FIG. 8 is a side view of the inner cap of FIG. 7.
FIG. 9 is a top perspective view of the inner cap of FIG. 7.
Figure 11:
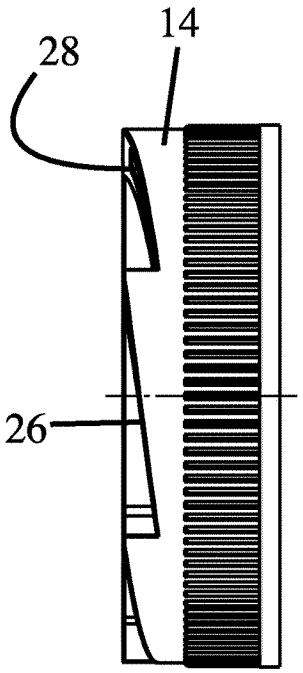
FIG. 11 is a side view of the inner cap of FIG. 10.
Figure 10:
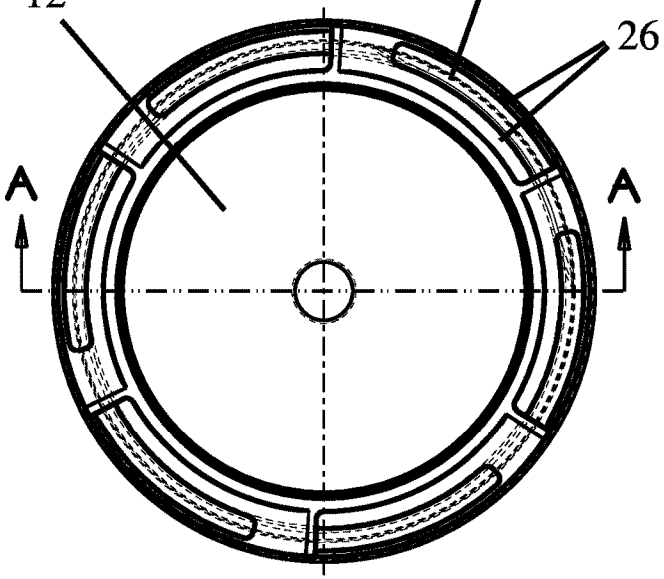
FIG. 10 is a top view of an inner cap according to another embodiment of the disclosure.
Figure 10A:
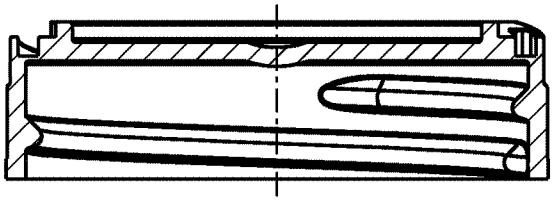
FIG. 10A is a cross sectional view of the inner cap of FIG. 10.
Figure 13:
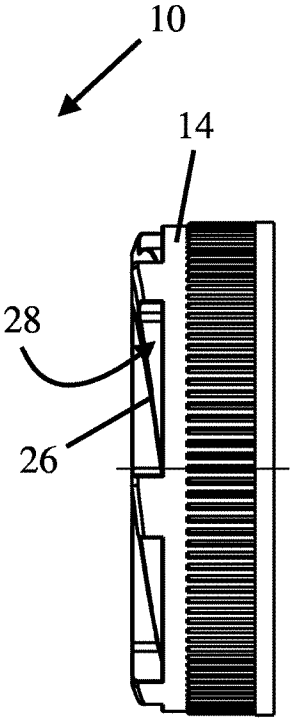
FIG. 13 is a side view of the inner cap of FIG. 12.
Figure 14:
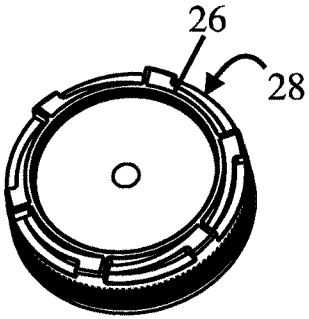
FIG. 14 is a top perspective view of the inner cap of FIG. 12.
Figure 12A:
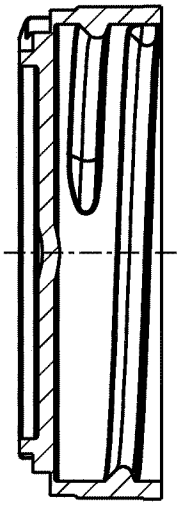
FIGS. 12A-12B are cross sectional views of the inner cap of FIG. 12.
Figure 12:
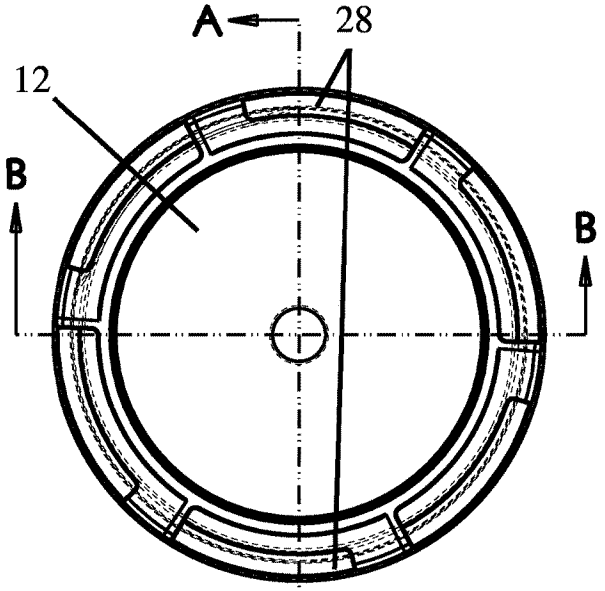
FIG. 12 is a top view of an inner cap according to another embodiment of the disclosure.
Figure 12B:
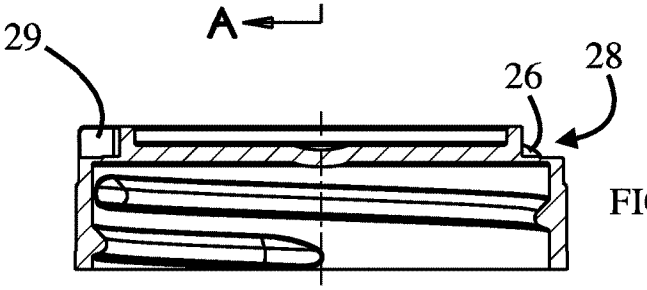

Referring to FIGS. 7-9, the receivers 28 may be integrated with the ratchet ramps by providing the receivers 28 as small indentions, similar to the receivers 28 of FIG. 1, along the ramp surfaces 26. According to this embodiment, the receivers 28 are disposed preferably proximate the distal end 27 of the ramp surface 26 to give more depth to the receivers 28. Alternatively, the receivers 28 could be provided by carving out an elongated slot/indention in each ramp surface 26 as shown in FIGS. 10-11. Referring to FIGS. 12-14, yet another embodiment is shown where the width of each ramp surface 26 is reduced such that the ramp surface does 26 not extend all the way out to the side wall 14. Accordingly, the receivers 28 are formed as elongated slots disposed between the ramp surface 26 and the side wall 14. It should be noted that the drive teeth 44 of outer cap 30 are dimensioned and configured such that the do not engage the receivers 28 when the outer cap 30 is turned in the second direction. For example, the drive teeth 44 may include a dimension that is larger than the receivers 28 so that the drive teeth 44 pass over the receivers 28 as they move up the ramp surface 26. Alternatively, the drive teeth 44 may be positioned and properly dimensioned on the interior top surface of the outer cap 30 such that the drive teeth 44 slide along the ramp surface without contacting the receivers 28.

In addition to moving the ratchet ramps 24 and receivers 28 of the lower cap 10 and apertures 46 of the outer cap 30 to the periphery of their respective caps, the top surface 12 of lower cap 10 is preferably recessed with respect to side wall 14. The recessed top surface 12 allows for additional depth around the outer circumference of the cap 10 where the ratchet ramps 24 and receivers 28 are located without increasing the depth of the top surface 12. In other words, the recessed top surface 12 avoids using more resin than normally required to allow for the additional depth around the outer circumference of the inner cap where the receivers 28 are found. This allows the interior side of the top surface 12 to be smooth, which aids in induction sealing and allows for the use of printed liners that can be viewed from the top of the cap with clear inner caps 10. Without these features, avoiding the pockets would require the top surface 12 of the inner cap 10 to be very thick, which requires additional resin, adding needless weight to the cap, and slowing down the molding/cycle time required to make the inner caps 10.

Figures 16, 16A, 16B:
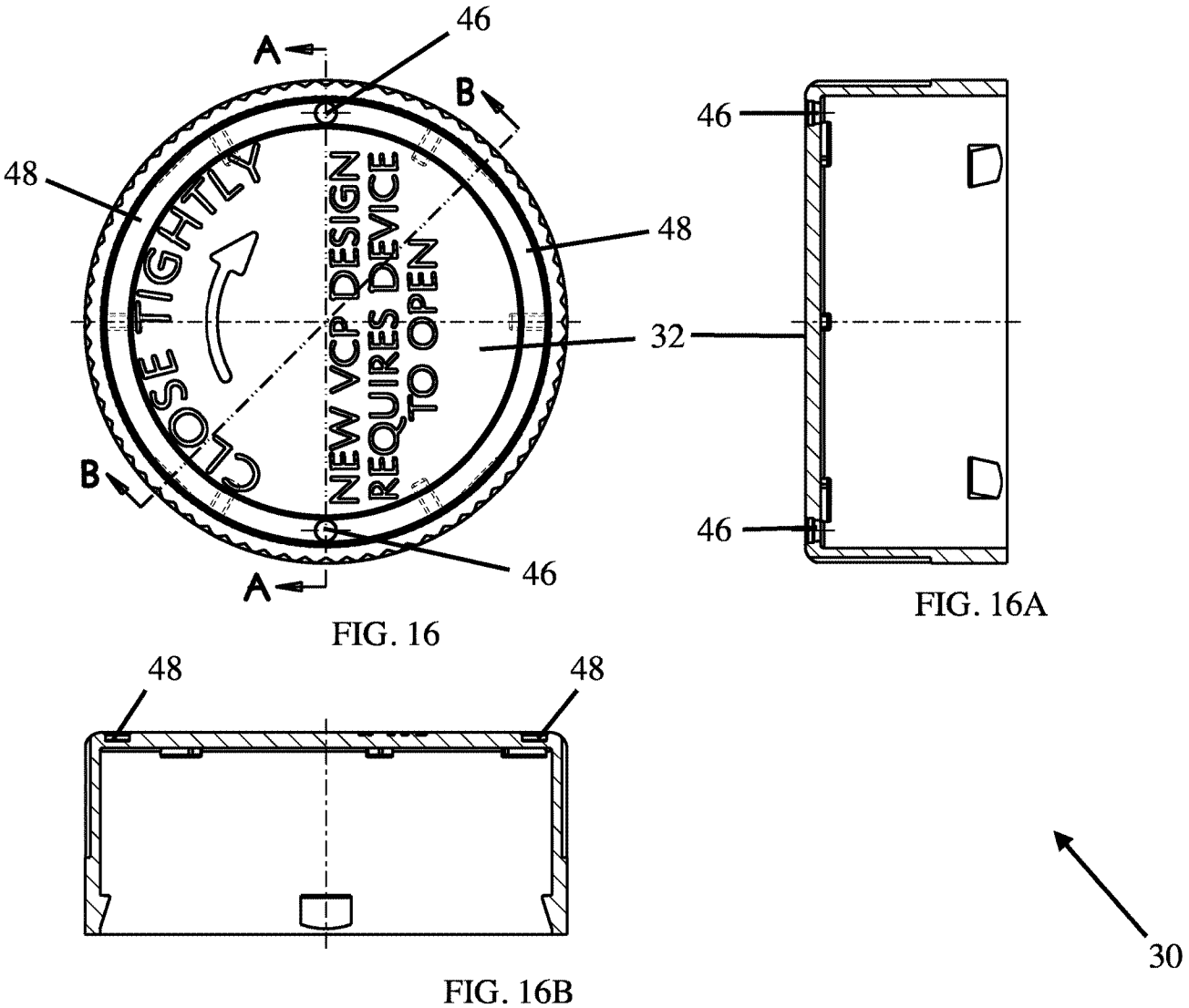
FIG. 16 is a top view of an outer cap according to another embodiment of the disclosure.
FIGS. 16A-16B are cross sectional views of the outer cap of FIG. 16.

Referring to FIG. 16, an alternate embodiment of outer cap 30 is provided having a groove 48 leading to apertures 46. Groove 48 provides a "driveway" to assist the user in locating and inserting the drive pins 54 into the apertures 46. In other words, once the drive pins 54 of key 50 are inserted into the groove 48, the user may rotate the key 50 along the groove until the drive pins 54 fall into the apertures 46. The groove 48 may extend around the entire circumference of the top surface 32 of the outer cap 30 as shown, or multiple grooves 48 may be provided of chosen lengths leading towards the apertures 46 as desired.

Figure 15A:
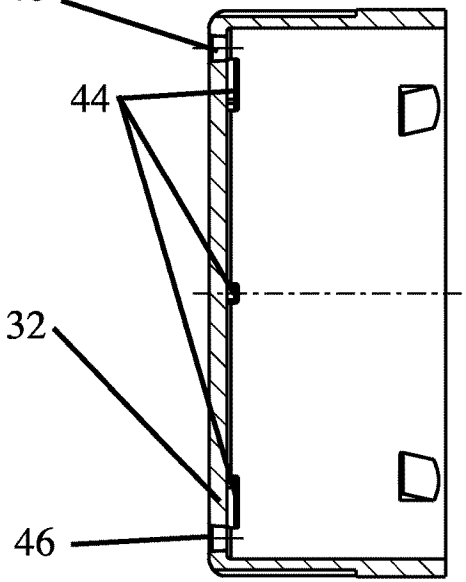
FIGS. 15A-15B are cross sectional views of the outer cap of FIG. 15.
Figure 15:
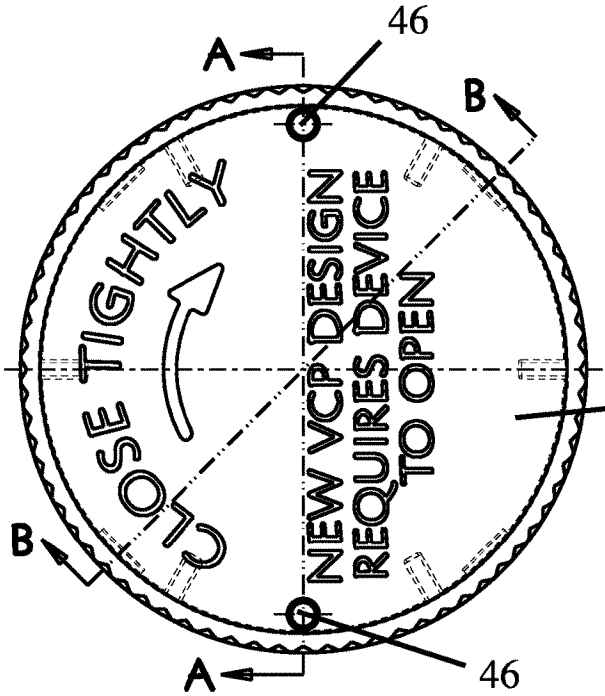
FIG. 15 is a top view of an outer cap according to another embodiment of the disclosure.
Figure 15B:
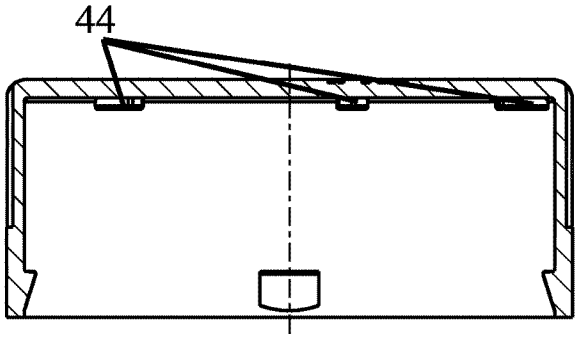
Figure 18A:
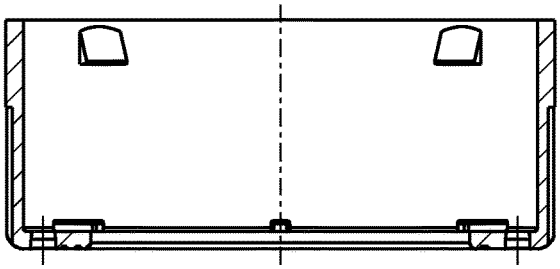
FIGS. 18A-18B are cross sectional views of the outer cap of FIG. 18.
Figure 18:
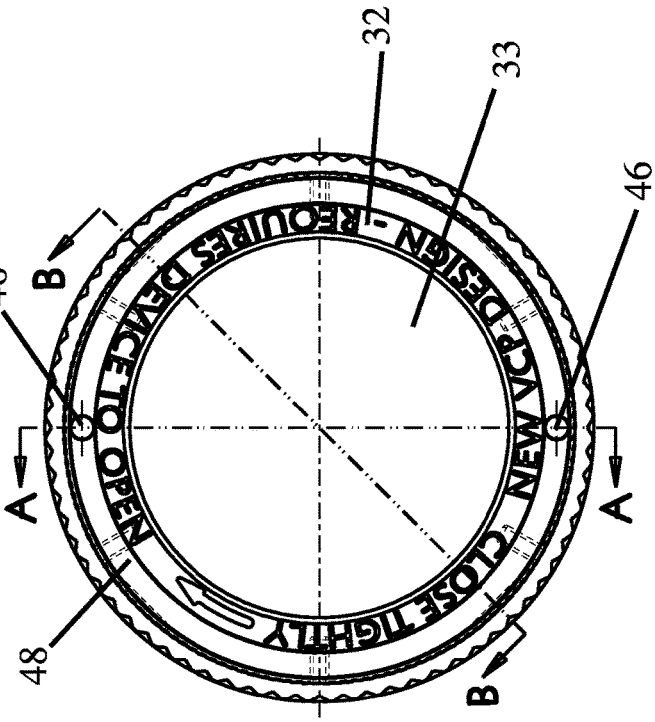
FIG. 18 is a top view of an outer cap according to another embodiment of the disclosure.
Figure 18B:
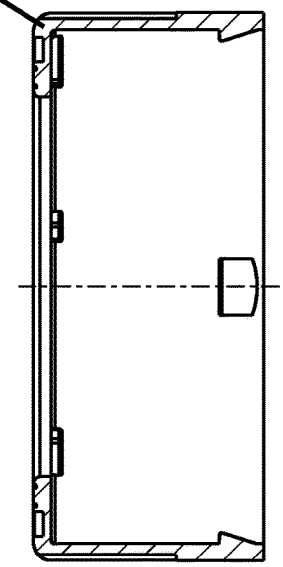
Figures 19, 20:
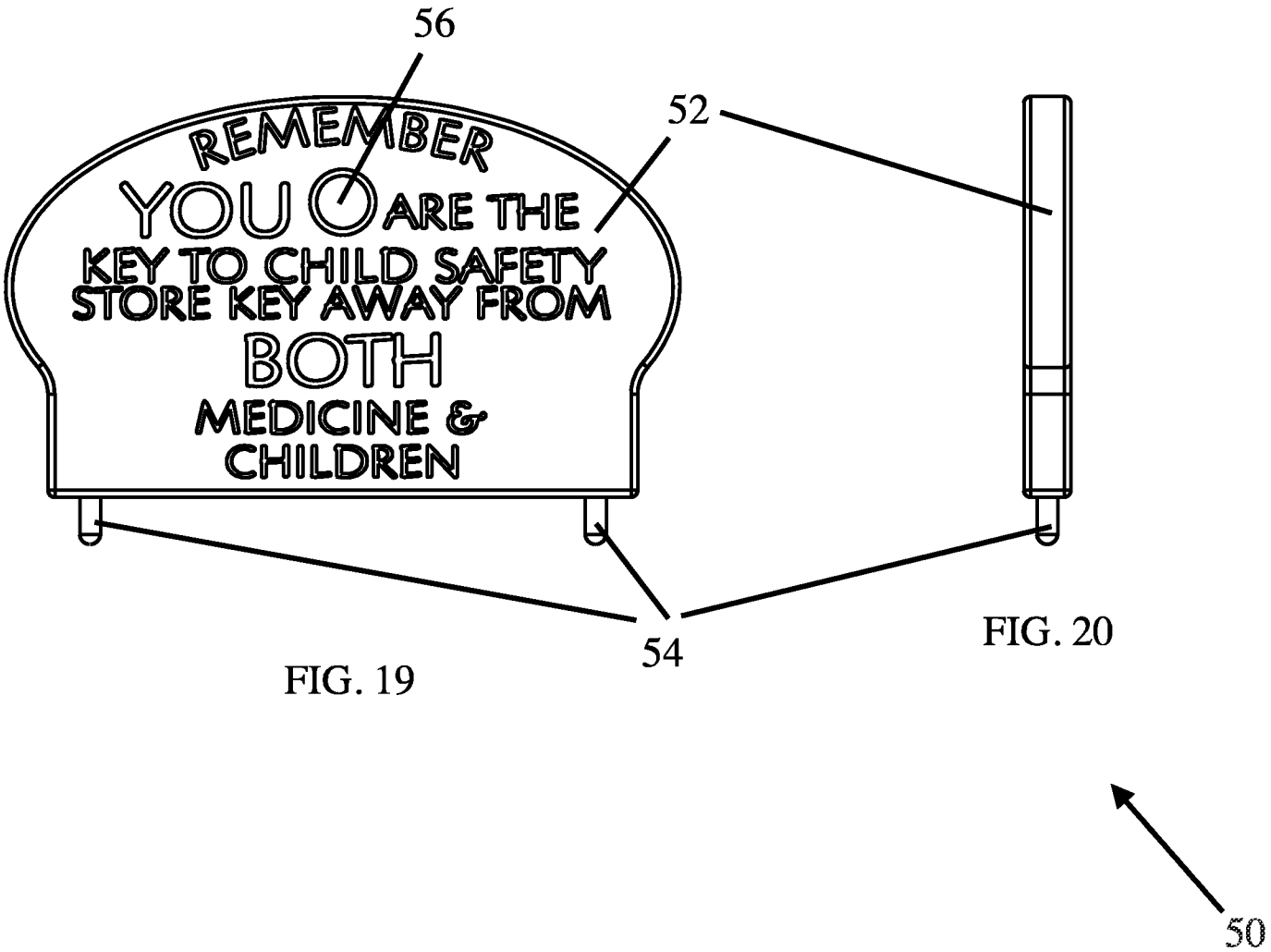
FIG. 19 is a front view of a wide-pin key according to one embodiment of the disclosure.
FIG. 20 is a side view of the key of FIG. 19.
Figures 23, 24:
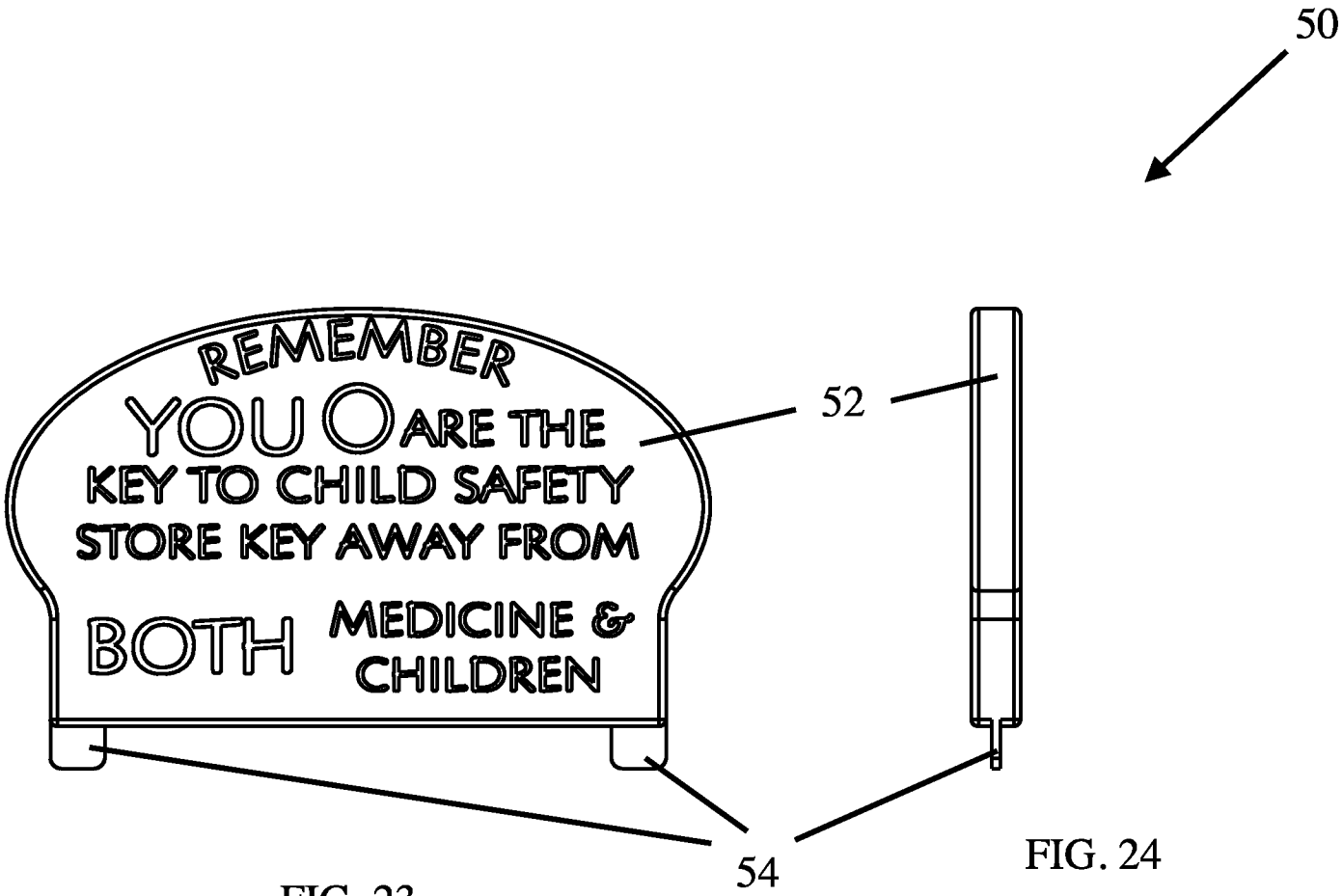
FIG. 23 is a front view of a key configured for the outer cap of FIG. 21.
FIG. 24 is a side view of the key of FIG. 23.

Referring to FIG. 17, an additional benefit of moving the receivers 28 to the outer periphery of the inner cap 10 and combining the receivers 28 with the ratchet ramps 24 is that the outer cap 30 may have a "donut" hole 33 or open top surface as opposed to a solid top surface 32 such as shown in FIGS. 15-16. According to this embodiment, the periphery of the top surface 32 of the outer cap 30 is defined by the rim extending from the side wall 34. In other words, the rim in this embodiment is referred to herein as the top surface 32 as well as the periphery of the top surface 32. As shown in FIG. 18, the "donut" hole outer cap 30 may also contain groove 48 as shown in FIG. 16. When the "donut" hole 33 outer cap 30 is used, the inner cap 10 may clear or otherwise see through such that a liner inserted into the interior of the inner cap 10 may be seen through the top surface 12.

Referring again to FIG. 1, the inner cap 10 preferably includes indicia that is visible only when the inner cap 10 is being used without an outer cap 30. The indicia is intended to notify the user that the closure is not child resistant. Referring to FIG. 3, the outer cap 30 may provide instructions as to how to remove the closure assembly from the container such as: TO OPEN-ALIGN KEY WITH HOLES-INSERT KEY & TWIST CAP OFF. However, in preferred embodiments such as shown in FIG. 15, the indicia of the outer cap 30 simply states that another device is needed to open the closure assembly: NEW VCP DESIGN REQUIRES DEVICE TO OPEN. In other words, the outer cap does not provide instructions (i.e., align key holes) as to how to open the closure other than the fact that a key is required. This prevents a small child capable of reading from being able to figure out how to open the closure assembly. The key 50 then preferably provides the operating instructions such as: ALIGN KEY WITH HOLES OF CLOSURE—INSERT KEY & TWIST.

Referring to FIGS. 21-25, the shape of the locking pins 54 of key 50 may take various forms. For example, as shown in this embodiment, the locking pins 54 are blade-shaped. As a result, the pin apertures 46 of outer cap 30 and receivers 28 of inner cap 10 are appropriately shaped and configured to receive the blade-shaped locking pins 54. With respect to this embodiment, as shown in FIGS. 21-22, the pin apertures 46 of outer cap 30 are in the form of slits carved into the outer periphery of the top surface 32 such that the slits extend down a portion of the side wall 34. According to this embodiment, the inner cap 10 is substantially as described above with respect to FIGS. 12-14 where the receivers 28 are formed with space disposed between the ramp surface 26 and the side wall 14 of the inner cap 10. Thus, the locking blade pins 54, when inserted into the pin slits 46 of outer cap 30 and receivers 28 of inner cap 10, are operable to engage the steep slope portion of the ratchet ramps 24 in either the closing or opening direction. In this regard, it is noted that, while the ramp surface 26 does not extend all the way to the side wall 14 of inner cap such that receivers 28 are formed between the ramp surface 26 and the side wall 14, the width of the steep slope portion of the ratchet ramp 24 does extend to the side wall 14 so that the pin slits 46 can engage the ratchet ramp in both the closing and opening directions. Alternately, ratchet ramp 24 may be excluded entirely with the exception of the steep slope portion such that the cap may not be screwed onto the container without the key 50.

Referring to FIGS. 26-34, an enhanced child resistant cap embodiment of the closure system is exemplified. According to this embodiment, as shown in FIGS. 26-29, the inner cap 60 includes a closed top surface 62, a circumferential side wall 64 extending downward from an outer periphery of the top surface 62 to create an open bottom surface 66, a closure engaging mechanism 68, and a plurality of drive elements 74 preferably disposed proximate the outer periphery of the closed top surface 62. Referring to FIGS. 30-34, outer cap 80 also includes a top surface 82 and a circumferential side wall 84 extending downward from an outer periphery of the top surface 82. Like outer cap 30, the interior surface of the circumferential side wall 84 includes tab elements 88 for engaging the bottom surface 66 of the inner cap 60 to secure the inner cap 60 within outer cap 80, the interior surface of the top surface 82 includes drive elements 94 for engaging the drive elements 74 of inner cap 60, and the top surface 82 includes one or more apertures 96 configured such that a key may be inserted through the apertures to engage the inner cap.

However, while ratchet ramps 24 of inner cap 10 and drive teeth 44 of outer cap 30 are preferably configured to prevent a push-down-and-turn action from removing the assembled closure from a container as described above, drive elements 74 of inner cap 60 and drive elements 94 of outer cap 80 are configured to permit removal using a push-down-and-turn action. Accordingly, the closure system is an "enhanced" child resistant closure system because, in addition to a standard child resistant configuration where the closure is configured to permit removal upon a push-down-and-turn action being applied, the closure system gives a user the option of utilizing the mechanical advantage of a key as described above to screw on and off the closure system.

As noted above, to increase the mechanical advantage of the key and decrease the size of the assembled closure, the apertures 96 are preferably disposed proximate the periphery of the top surface 82 and the key receiver of the inner cap 60 is preferably integrated with the drive elements 74. Thus, the drive elements 74 of inner cap must be configured to be engaged by the drive elements 94 of outer cap 80 and the projections 54 of key 50.

Figure 29:
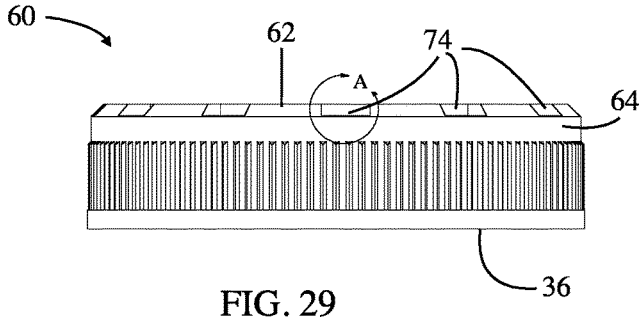
FIG. 29 is a side view of the inner CAP of FIGS. 26-28.
Figure 29A:
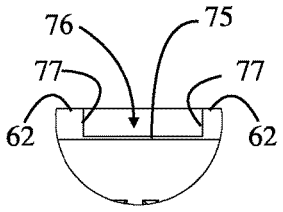
FIG. 29A is an exploded view of the "A" region of FIG. 29.
Figure 30:
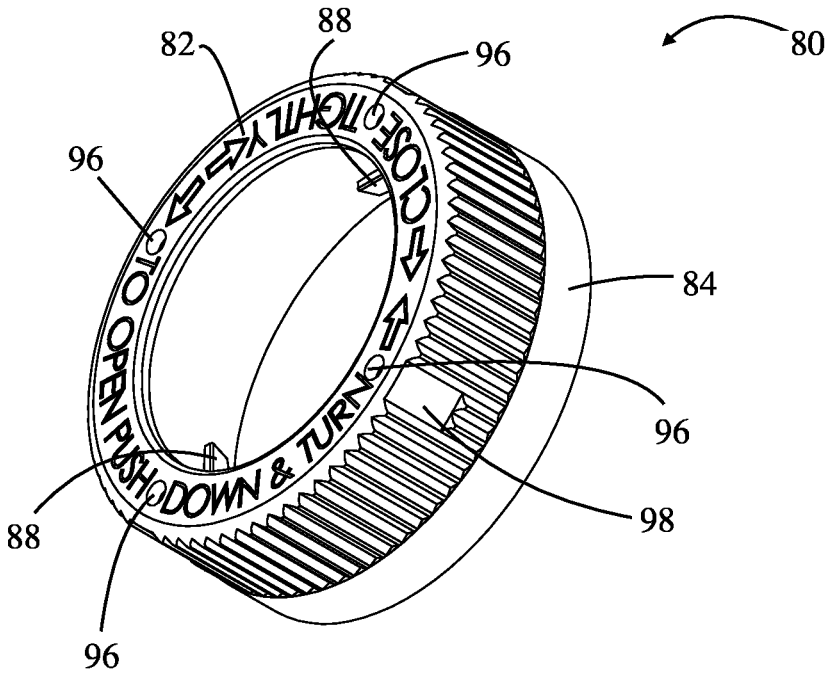
FIG. 30 is a top perspective view of an outer cap according to another embodiment of the disclosure.
Figure 31:
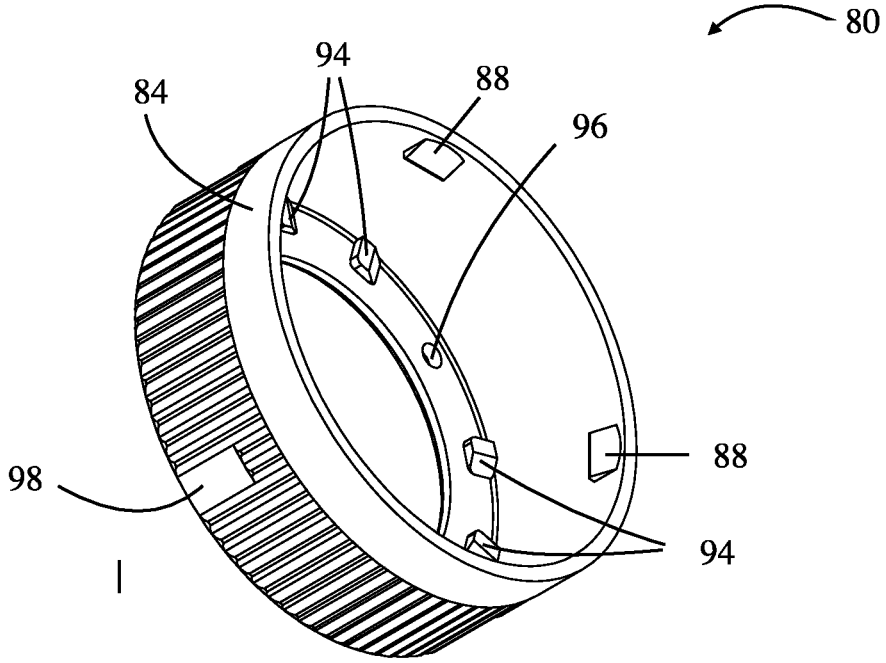
FIG. 31 is a bottom perspective view of the outer cap of FIG. 30.
Figure 32:
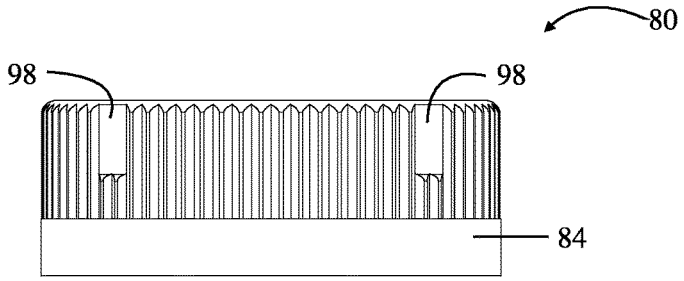
FIG. 32 is a side view of the outer cap of FIGS. 30-31.
Figure 33:
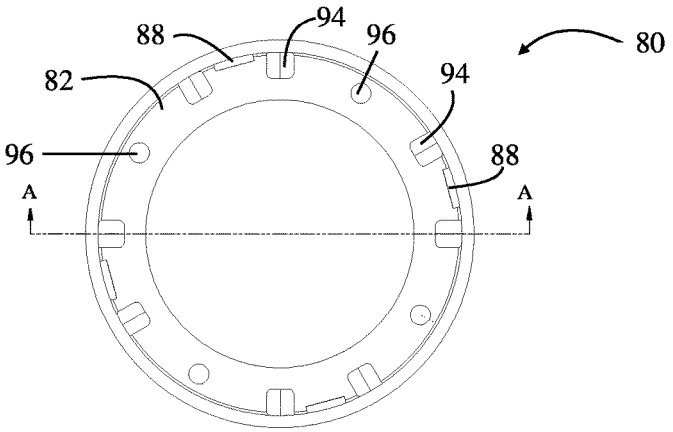
FIG. 33 is a bottom view of the outer cap of FIGS. 30-32.
Figure 33A:
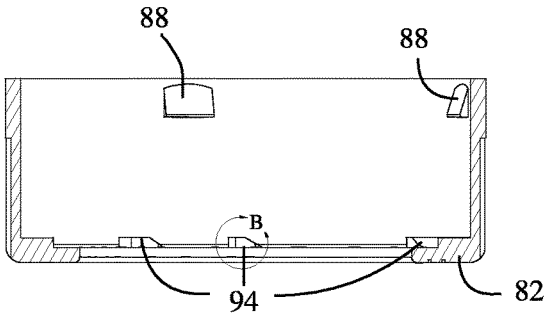
FIG. 33A is a cross sectional view taken from plane "A" of FIG. 33.
Figure 33B:
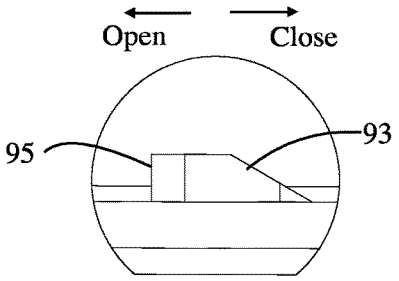
FIG. 33B is an exploded view of region "B" of FIG. 33A.
Figure 34:
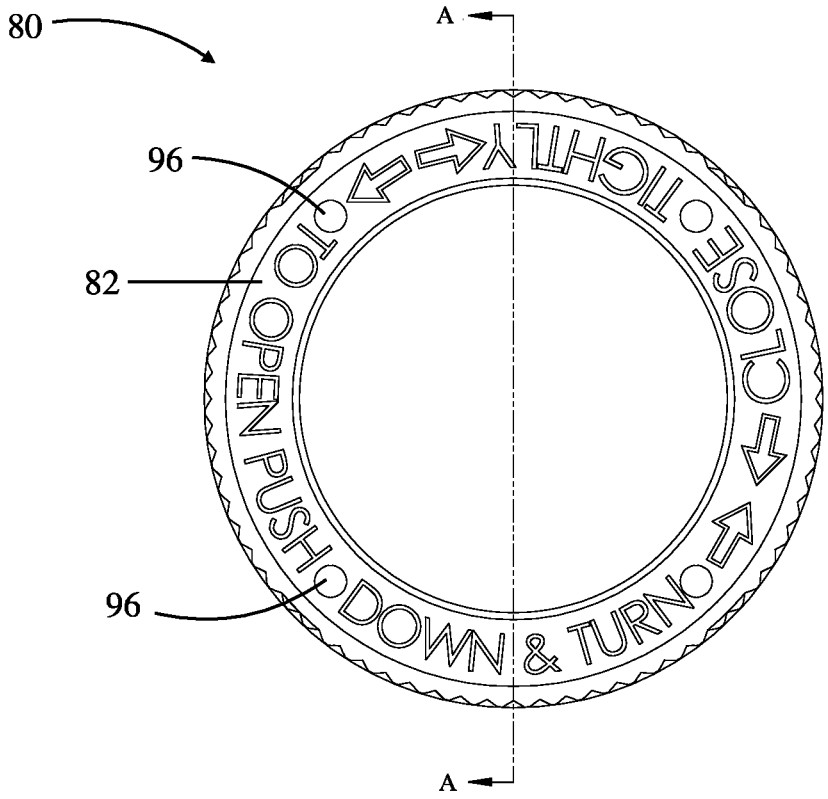
FIG. 34 is a top view of the outer cap of FIGS. 30-33.
Figure 34A:
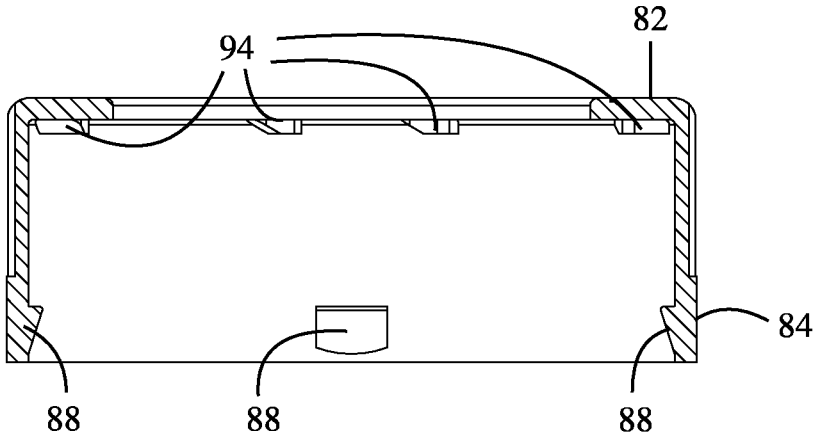
FIG. 34A is a cross sectional view taken from plane "A" of FIG. 34.

In preferred embodiments, each of the drive elements 74 of the inner cap 60 for are best described as "pockets" sunk into the top surface 62 instead of ratchet ramps 24 and the drive elements 94 of outer cap 80 are in the form of ratchet ramps instead of drive teeth 44. As best shown in the exploded view of FIG. 29A, each pocket 74 includes a recess 76 preferably having a bottom wall 75 that is coaxial with the top surface 72 and a pair of opposing side walls 77 extending substantially perpendicular from the bottom wall 75 to the top surface 72. Then, as best shown in the exploded view of FIG. 33B, each of the ratchet ramps of outer cap include an at least partially angled ramp surface 93 that ends at a vertical member 95 extending towards and substantially perpendicular to the top surface 82 of the outer cap 80.

Accordingly, when turning the outer cap in the first direction, the plurality of ratchet ramps 94 of the outer cap 80 engage the plurality of recesses 76 of the inner cap 60 via each vertical member 95 engaging an appropriate side wall 77 of a recess 76. However, when turning the outer cap 80 in the second direction, the ramp surfaces 93 are unable to engage the opposing side wall 77 of the recesses 76 without a depressive axial force being applied to the outer cap 80. On the other hand, when projections 54 of key 50 are inserted through the apertures 96 of outer cap 80 and into recesses 72 aligned with the apertures 96, the projections are able to engage both side walls 77 depending on which direction the key 50 is rotated.

One advantage of adapting the driving elements 74 of the inner cap 60 to include pockets configured to receive the one or more projections 54 of key 50 is that the height of the inner cap 60 is able to be decreased, resulting in a more aesthetically pleasing appearance of the closure assembly and a closure assembly 10 that may be produced more efficiently. The reduction in size is a result of the inner cap 60 (1) not needing an additional indention to receive the key; and (2) the inclusion of pockets 74 disposed within the top surface 62 of inner cap 60 instead of ramps or other locking mechanisms protruding from the top surface 62. In preferred embodiments, the thickness of the top surface 72 of the inner cap 60 is about 1.25 mm to about 1.5 mm with the recess 76 extending about 0.9 mm to about 1 mm into the top surface 62.

To further assist a customer in aligning the projections 54 with apertures 96 of outer cap 80, the exterior surface of side wall 80 preferably includes a discrete alignment feature 98 indicating the location of the apertures 96 on the top surface 82 of the outer cap 80. In preferred embodiments, and as shown in the drawings, the alignment feature includes a small break 88 in the knurlments of the outer cap 80. Such breaks in the knurlments are not only visible to a person with relatively good eyesight, they are able to be located by feel by those with poor eyesight.

According to another embodiment of the disclosure, it is noted that the closure assembly of FIGS. 26-34 may be changed to a child proof closure by simply eliminating the drive elements 94 of the outer cap 80.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A closure comprising:

an outer cap including a plurality of drive elements disposed proximate a top interior surface of the outer cap and at least two apertures extending through an exterior surface of the outer cap proximate the top surface;

an inner cap dimensioned and configured to be assembled within the outer cap, the inner cap including:

a closure engaging mechanism disposed on an interior surface of the inner cap, the closure engaging mechanism dimensioned and configured to engage a corresponding container engaging mechanism for securing the inner cap to a container, and a plurality of drive elements disposed proximate a top exterior surface of the inner cap operable to engage the plurality of drive elements of the outer cap when the outer cap is turned in a first direction to screw the assembled closure onto a container, wherein at least two of the plurality of drive elements are configured to include a key receiver integrated within the drive element; and a key having at least two projections extending from a handle portion, the at least two projections dimensioned and configured to be inserted through the at least two apertures of the outer cap to engage the at least two key receivers of the plurality of drive elements of the inner cap when the at least two apertures of the outer cap are vertically aligned with the at least two key receivers of the plurality of drive elements of the inner cap and the key is rotated in at least the second direction for removing the assembled closure from the container.

2. The closure of claim 1 wherein the plurality of drive elements of the outer cap are disposed proximate a periphery of the top interior surface, the at least two apertures are disposed proximate a periphery of the exterior surface of the outer cap, and the plurality of drive elements of the inner cap are disposed proximate a periphery of the top exterior surface of the inner cap.

3. The closure of claim 2 wherein the plurality of drive elements of the outer cap and the plurality of drive elements of the inner cap are dimensioned and configured to permit removal of the assembled closure upon a push-down-and-turn action being applied to the outer cap in the second direction.

4. The closure of claim 3 wherein the plurality of drive elements of the inner cap include pockets disposed in the top surface of the inner cap having opposing side walls extending substantially perpendicular from the top surface, the pockets forming the at least two key receivers of the inner cap.

5. The closure of claim 1 wherein the plurality of drive elements of the outer cap and the plurality of drive elements of the inner cap are dimensioned and configured to prevent removal of the assembled closure upon a push-down-and-turn action being applied to the outer cap in the second direction.

6. The closure of claim 5 wherein each of the plurality of drive elements of the outer cap and each of the plurality of drive elements of the inner cap include an elongated ramp surface rising from a proximal end to a distal end at an angle of 20 degrees or less.

7. The closure of claim 5 wherein at least one of the inner cap and the outer cap is molded with a lubricating agent.

8. The closure of claim 5 further comprising a second inner cap operable to be assembled with the outer cap, the second inner cap dimensioned and configured so that the plurality of drive elements of the outer cap are operable to engage a plurality of drive elements of the second inner cap when the second inner cap is assembled within the outer cap upon a push-down-and-turn action being applied to the outer cap in the second direction.

9. The closure of claim 1 wherein the at least two projections of the key are configured to be removeably attached to the at least two key receivers of the inner cap.

10. The closure of claim 1 wherein the at least two apertures of the outer cap are vertically aligned with the at least two key receivers of the plurality of drive elements of the inner cap when a user turns the outer cap in the first direction such that the plurality of drive elements of the outer cap are in engagement with the plurality of drive elements of the inner cap.

11. The closure of claim 1 wherein the outer cap includes at least two grooves disposed in the top surface leading to the at least two apertures for assisting a user in locating the at least two apertures with the at least two projections of the key.

12. The closure of claim 1 wherein the handle portion of the key includes a width that is greater than the diameter of the outer cap.

13. The closure of claim 1 wherein the inner cap is operable to be secured to the container unassembled from the outer cap in a non-child resistant configuration.

14. A closure comprising:

an outer cap including a plurality of drive elements disposed proximate a top interior surface of the outer cap and at least two apertures extending through an exterior surface of the outer cap;

an inner cap dimensioned and configured to be assembled within the outer cap, the inner cap including:

a closure engaging mechanism disposed on an interior surface of the inner cap, the closure engaging mechanism dimensioned and configured to engage a corresponding container engaging mechanism for securing the inner cap to a container, a plurality of drive elements disposed proximate a top exterior surface of the inner cap operable to engage the plurality of drive elements of the outer cap when the outer cap is turned in a first direction to screw the assembled closure onto a container and permit removal of the assembled closure upon a push-down-and-turn action being applied to the outer cap in a second direction and at least two key receivers disposed proximate an exterior surface of the inner cap; and a key having at least two projections extending from a handle portion, the at least two projections dimensioned and configured to be inserted through the at least two apertures of the outer cap to engage the at least two key receivers of the inner cap when the at least two apertures of the outer cap are vertically aligned with the at least two key receivers of the inner cap and the key is rotated in at least the second direction for removing the assembled closure from the container.

15. The closure of claim 14 wherein the plurality of drive elements of the outer cap are disposed proximate a periphery of the top interior surface and the at least two apertures are disposed proximate a periphery of the exterior surface, the plurality of drive elements of the inner cap are disposed proximate a periphery of the top exterior surface, and the assembled closure is dimensioned and configured such that the at least two projections are operable to be inserted through the at least two apertures of the outer cap to engage the at least two key receivers of the inner cap.

16. The closure of claim 14 wherein the plurality of drive elements of the inner cap include pockets disposed in the top surface of the inner cap having opposing side walls extending substantially perpendicular from the top surface, each of the pockets forming one of the at least two key receivers of the inner cap.

17. The closure of claim 16 wherein the plurality of drive elements of the outer cap include ratchet ramps.

18. The closure of claim 15 wherein each of the plurality of drive elements of the inner cap include a ratchet ramp having an elongated ramp surface dimensioned and configured so that the plurality of drive elements of the outer cap are operable to engage the ratchet ramps when the outer cap is turned in a first direction to screw the assembled closure onto a container while preventing a user to apply a depressive axial force and simultaneous turning of the outer cap in a second direction opposite the first direction to unscrew the assembled closure from the container.

19. The closure of claim 18 wherein each of the at least two receivers are integrated with one of the ratchet ramps.

20. The closure of claim 19 wherein each of the ratchet ramps include a top ramp surface and each of the at least two receivers include an indention disposed in one of the top ramp surfaces.

21. The closure of claim 20 wherein each of the indentions are an elongated slot formed into the top ramp surface.

22. The closure of claim 19 wherein the inner cap further comprises a circumferential sidewall and a portion of at least two of the ratchet ramps include a reduced width that provides space between the ratchet ramp and a periphery of the inner cap, the spaces forming the at least two receivers.

23. The closure of claim 19 wherein the inner cap further comprises a circumferential sidewall and a top exterior surface, the top exterior surface being recessed within the circumferential side wall to provide depth to the ratchet ramps disposed between the top exterior surface and the circumferential side wall of the inner cap.

24. The closure of claim 18 wherein the inner cap is operable to be secured to the container unassembled from the outer cap in a non-child resistant configuration.

25. The closure of claim 18 wherein the at least two key receivers of the inner cap include indentions in the elongated ramp surfaces of at least two of the ratchet ramps.

26. The closure of claim 18 wherein the elongated ramp surfaces of the ratchet ramps each rise from a proximal end to a distal end at an angle of 20 degrees or less.

27. The closure of claim 26 wherein at least one of the inner cap and the outer cap is molded with a lubricating agent.

28. A closure comprising:

an outer cap including at least two spaced apart apertures disposed proximate a periphery of a top surface of the outer cap;

an inner cap having a top surface and a circumferential sidewall disposed below the top surface, the inner cap dimensioned and configured to be assembled within the outer cap, the inner cap including:

a closure engaging mechanism disposed on an interior surface of the inner cap, the closure engaging mechanism dimensioned and configured to engage a corresponding container engaging mechanism for securing the inner cap to a container, and at least two spaced apart receivers corresponding to the at least two spaced apart apertures of the outer cap, each of the at least two spaced apart receivers include a recess formed into the top surface adjacent the circumferential sidewall such that the at least two apertures of the outer cap are operable to be vertically aligned with the at least two spaced apart receivers of the inner cap; and a key having at least two spaced apart projections extending from a handle portion, the spaced apart projections dimensioned and configured to be inserted through the at least two spaced apart apertures of the outer cap to engage the at least two spaced apart receivers of the inner cap when the spaced apart apertures of the outer cap are vertically aligned with the spaced apart receivers of the inner cap for screwing and unscrewing the assembled closure from the container by turning the key.

29. The closure of claim 28 wherein each of the receivers of the at least two spaced apart receivers include pockets sunk into the top surface of the inner cap, each pocket having a base wall and a pair of opposing side walls extending from the base wall to the top surface.

30. The closure of claim 28 wherein the top interior surface of the inner cap is substantially smooth for closing an opening of the container.

31. The closure of claim 28 wherein the outer cap includes an open top surface having a rim defining the periphery of the top surface of the outer cap.

32. The closure of claim 28 wherein the at least one set of spaced apart projections of the key are configured to be removeably attached to the at least one set of spaced apart receivers of the inner cap.

33. The closure of claim 28 wherein the outer cap includes one or more grooves leading to each of the apertures of the at least two apertures for assisting a user in locating the apertures with the at least two spaced apart projections of the key.

34. The closure of claim 28 wherein the handle portion of the key includes a width that is at least substantially equal to a diameter of the outer cap.

35. The closure of claim 28 wherein the handle portion of the key includes a width that is greater than the diameter of the outer cap.

36. The closure of claim 28 wherein the inner cap is operable to be secured to the container unassembled from the outer cap in a non-child resistant configuration.

37. The closure of claim 28 wherein the inner cap and outer cap are operable to permit removal of the assembled closure upon a push-down-and-turn action being applied to the outer cap.

38. The closure of claim 28 wherein the inner cap and outer cap are operable to prevent removal of the assembled closure without the key.

* * * * *